US009052170B1

(12) United States Patent
Campbell et al.

(10) Patent No.: US 9,052,170 B1
(45) Date of Patent: Jun. 9, 2015

(54) ACTUATING BIRD-WING ARROW BLADE

(71) Applicants: Michael L Campbell, Flagstaff, AZ (US); Robert Lee Campbell, Flagstaff, AZ (US)

(72) Inventors: Michael L Campbell, Flagstaff, AZ (US); Robert Lee Campbell, Flagstaff, AZ (US)

(73) Assignee: Slick Hunting Products Inc, Flagstaff, AZ (US)

( * ) Notice: Subject to any disclaimer, the term of this patent is extended or adjusted under 35 U.S.C. 154(b) by 0 days.

(21) Appl. No.: 14/453,599

(22) Filed: Aug. 6, 2014

Related U.S. Application Data

(60) Provisional application No. 61/886,738, filed on Oct. 4, 2013.

(51) Int. Cl.
*F42B 6/08* (2006.01)
*F42B 12/34* (2006.01)

(52) U.S. Cl.
CPC .. *F42B 6/08* (2013.01); *F42B 12/34* (2013.01)

(58) Field of Classification Search
USPC ..... 473/582, 583, 584
See application file for complete search history.

(56) References Cited

U.S. PATENT DOCUMENTS

| | | | | |
|---|---|---|---|---|
| 2,725,656 | A | 12/1955 | Schmidt | |
| 2,937,873 | A | 5/1960 | Grissinger | |
| 2,939,708 | A | 6/1960 | Scheib | |
| 3,014,305 | A | 12/1961 | Yurchich | |
| 3,604,708 | A | 9/1971 | Brozina | |
| 6,270,435 | B1 | 8/2001 | Sodaro | |
| 6,830,523 | B1 | 12/2004 | Kuhn | |
| 7,311,622 | B1 | 12/2007 | Futtere | |
| 7,485,056 | B2 | 2/2009 | Sullivan | |
| 7,713,152 | B1 | 5/2010 | Tentler | |
| 8,043,177 | B2 | 10/2011 | Flanagan | |
| 8,057,331 | B2 | 11/2011 | Hudkins | |
| 8,105,188 | B1 | 1/2012 | Mercer | |
| 8,133,138 | B1 * | 3/2012 | Hannah | 473/583 |
| 8,182,378 | B1 | 5/2012 | Futtere | |
| 8,449,415 | B2 | 5/2013 | Grace | |
| 8,449,416 | B2 | 5/2013 | Grace | |
| 2007/0156162 | A1 | 7/2007 | Kammerer | |

* cited by examiner

*Primary Examiner* — John Ricci
(74) *Attorney, Agent, or Firm* — Invention To Patent Services; Alex Hobson

(57) ABSTRACT

A bird-wing broadhead blade is a blade that has a free end that is positioned in a back or downstream position from a fixed end. The free end of the bird-wing blade extends out, like a bird opens its wings to fly. A bird-wing broadhead blade may incorporate a shape memory alloy material that has a set shape, such as by thermal setting. A shape memory alloy bird-wing broadhead blade may be deformed into a strained shape and retained until hitting an object. When the shape memory blade is released, it will move into the set shape automatically. A shape memory alloy is a metal alloy that "remembers" its set shape and has superelastic properties. A spring deployment system may also be used to deploy one or more bird-wing blades. A spring may be configured upstream or downstream of the fixed end of the blades.

21 Claims, 26 Drawing Sheets

ACTUATING BIRD-WING ARROW BLADE

CROSS REFERENCE TO RELATED APPLICATIONS

This application claims the benefit of U.S. provisional patent No. 61/886,738 entitled Bird-Wing Broadhead Blade and Bird-Wing Insert filed on Oct. 4, 2013; the entirety of which is incorporated by reference herein.

BACKGROUND OF THE INVENTION

1. Field of the Invention

The present invention relates to broadheads and particularly to those with actuating blades.

2. Background

Bow hunters use either a fixed blade broadhead or a mechanical blade broadhead. A fixed blade broadhead, as shown in FIG. 1, has the blades 40, 40' in a fixed position extending out from the arrowhead body 34. These extended blades may cause planing in flight, whereby the arrow does not drop over a flight path in a consistent manner and thereby makes it more difficult to reliably hit a target. In addition, fixed blades extend a substantial distance from the broadhead body and can create a lot of drag in flight which may reduce penetration into a game animal because of reduced velocity. The cutting surfaces 54 of the blades, as shown in FIG. 1, are exposed and may dull during penetration through an animal's hide. Many game animals have very tough hides which can quickly dull cutting surfaces. If arrowhead blades have a reduced sharpness after penetration through a hide, they may have a reduced penetration into the animal, and therefore not be as effective.

A mechanical blade insert 42 is shown in FIG. 2A having three mechanical blades 43 attached to an insert disc 44. The free ends of the blades are configured to extend forward from the insert disc when coupled to a broadhead 33. The mechanical blades are configured partially into a slot 35 within the arrow body 34. The free ends 76 of the mechanical blades 43 point forward, or in the direction of flight of the arrow when shot. The free ends are configured more proximal to the entry end of the broadhead when in a retained configuration as shown FIGS. 2B and 2C. The broadhead 33 is shown coupled to an arrow shaft 20 in FIG. 2C. A retainer 65 is typically configured around the mechanical blades to keep them in a forward position until the arrow 12 impacts a target, as shown in FIG. 2C. When the arrow 12 hits a target, the free ends 76 of the mechanical blades are forced backward and the retainer is released. The blades fall back into a deployed position as shown in FIG. 2D. The blades typically hit a stop that holds them in an extended position as the arrow penetrates a target object. Note that the cutting surfaces 54 of the mechanical blades also have to cut through the outer portion of a target, or the hide of an animal, as they are deployed during initial entry into a target. When this type of mechanical broadhead hits a target, there is a considerable amount of inertial loss due to the blade resisting entry and being deployed backward. This sudden and substantial reduction in velocity may result in less penetration into a target, such as an animal, and therefore be less effective. Also, the mechanical blades, as shown in FIG. 2D, have no give or flex in the event that they hit an object 95, such as bone within a game animal. The mechanical blades may break and will dramatically loose velocity if a hard object is hit by the blades. In addition, a blade hitting a hard object can deflect the arrow trajectory.

Material selection is also an important aspect of broadheads. A broadhead blade should be sharp to enable deep penetration. The broadhead blade is preferably durable, resistant to damage, chipping, permanent bending, blunting, and able to maintain a sharp edge. A broadhead blade should also be corrosion resistant to be able to withstand various environments in the field without compromising the integrity of the blades. Currently, broadheads are manufactured using materials such as austenitic stainless steels, martensitic stainless steels, and aluminum. These current broadhead materials have some undesirable attributes. Aluminum broadheads blades have low hardness and, as a result, are unable to maintain a sharp edge. The sharp edges quickly become dull during use, such as when passing through an animal's hide. Martensitic stainless steels, although having a high hardness, are relatively brittle and subject to chipping and breaking. In addition, martensitic stainless steels are susceptible to corrosion and can rust, particularly after sharpening. Austenitic stainless steels also have relatively low hardness and are incapable of maintaining a sharp edge during repeated use

SUMMARY OF THE INVENTION

The invention is directed to a bird-wing broadhead blade and mechanism for deploying a broadhead blade. A bird-wing broadhead blade is a blade that has a free end that is positioned in a back or downstream position from a fixed end when in a retained configuration. The free end of the bird-wing blade, as described herein, extends out like a bird opens its wings during flight. The free end pivots away from the body. A bird-wing blade may comprise a shape memory material that has a set shape, such as by thermal setting. A shape memory type bird-wing blade may be deformed, defected, and/or bent into a strained shape, or state, and retained until hitting an object. When the shape memory blade is released from a strained state, it will move into the set shape, or extended shape automatically. A shape memory alloy is a metal alloy that "remembers" its set shape and has superelastic properties. A shape memory blade may comprise any suitable type of shape memory alloy including, but not limited to, copper-aluminum-nickel, and nickel-titanium or nitinol. A bird-wing blade may consists essentially of shape memory material or a portion of the blade may be configured out of shape memory material, such as a spring blade portion, as described herein.

In another embodiment, a shape memory blade, or a non-shape memory blade may be actuated by a spring, whereby the spring forces the bird-wing broadhead blade to pivot out and away from the arrow body. A spring may be configured upstream, or more forward a pivot location or fixed end, or a spring may be configured downstream, or back from a pivot location or fixed end of the blade.

A bird-wing blade may be configured as part of a broadhead arrow, such as attached to the broadhead arrow. In another embodiment, a bird-wing blade is configured as part of an insert for a broadhead arrow. One, two or more bird-wing blades may be coupled to an insert that may be slid onto, or otherwise coupled to a broadhead. A retainer may be used to retain the bird-wing broadhead blades in a retained or strained orientation. A retainer may be a ring of material that extends around the free ends of the blades or around a retainer protrusion or extension. A retainer is configured to release the one or more bird-wing blades when the arrow enters an object. In an exemplary embodiment, the retainer is configured back or downstream of the fixed end of the bird-wing blade, therefore the bird-wing blades are not released until the arrow has already penetrate into an object down to the location of the retainer.

A broadhead or broadhead insert may comprise one, two, three, four, five, six of more bird-wing blades. A blade made of nitinol, for example, may be thinner than conventional blades because of its high hardness. A bird-wing blade may have any suitable thickness, such as no more than about 0.010 inches, no more than about 0.015 inches, no more than about 0.020 inches, no more than about 0.030 inches and any range between and including the thicknesses provided.

A bird-wing blade may be attached directly to a broadhead or may be configured as part of an insert. One or more bird-wing blades may be coupled to an insert body that is configured to be detachably attached to a broadhead arrow. The insert may comprise an aperture that can be slid onto the broadhead arrow and the shaft of the arrow may be screwed onto the broadhead arrow to secure the insert in place. An insert body may be simply a ring with the bird-wing broadhead blades extending therefrom. In another embodiment, an insert may comprise a threaded portion, such as a threaded hole, for attachment of the arrowhead and a threaded portion, such as a male threaded portion, for attachment of the arrow shaft. In still another embodiment, the insert body may have a length that is configured to extend along the axis of the arrow, whereby a retainer is configured to attach around the insert body. In addition, an insert body may be configured to attach an arrow point to one end and an arrow shaft to the opposing end. In still another embodiment, an insert body or arrowhead body comprises a slot or slots for receiving a portion of the bird-wing blades, whereby a portion of the bird-wing broadhead blades may be retained within the slot. An insert body may comprise a slot for receiving the fixed end and the pivot point of the bird-wing blade may be recessed within the arrowhead body. In another embodiment, an extended portion of the bird-wing blade, including the free end, may be configured within a slot within the arrowhead body or insert.

The bird-wing broadhead blade has a free end that is configured to be downstream of a fixed end when in a retained configuration. Downstream, meaning down along the length of the arrow in the direction of flight, whereby the fixed end of a bird-wing broadhead blade will enter an object before the free end of the bird-wing broadhead blade. Put another way, the fixed end of the bird-wing arrow is configured more proximal to the entry end of the broadhead than the free end, when in a retained configuration. The blades may be configured in a strained state or shape, whereby the blades are bent, deformed or strained down toward the centerline of the arrow. The bird-wing broadhead blades may be retained in this strained state whereby when they are released, they extend out, or return to a set shape to provide a wider cutting path. The superelastic properties of the bird-wing blade enables the blade to move automatically back to a set shape. The bird-wing broadhead blades may have any suitable shape and at least one cutting surface. The bird-wing broadhead blades may be planar in shape having a first substantially planar surface, and a second substantially planar surface and a thickness between said first and second substantially planar surfaces.

The bird-wing broadhead blades have a cutting surface and this cutting surface may comprise an entry cutting surface and a protected cutting surface. An entry cutting surface is the cutting surface that will be exposed to the object upon entry into the object. A protected cutting surface is recessed within the entry plane of the entry cutting surface blades. A bird-wing broadhead blade may be configured with a curved outer surface, or cutting surface, whereby a portion extending from the fixed end is an entry cutting surface. A bird-wing broadhead blade may be configured with an entry offset distance, or distance from the center line of the arrow to the entry plane of the bird-wing broadhead blade. The entry offset distance may be any suitable distance including, but not limited to, about 0.125 inch or more, about 0.25 inch or more, about 0.38 inch or more, about 0.5 inch or more, about 0.75 inch or more, about 1.0 inch or more, and any range between and including the distances provided. A bird-wing broadhead blade has a length from the fixed end to the free end. The length is measured along the contour of the cutting surface side of the blade. A bird-wing broadhead blade may be configured with a protected cutting surface that extends any suitable portion of the blade length including, about 25% or more, about 50% or more, about 75% or more, about 85% or more, about 90% or more, about 95% or more and any range between and including the values provided.

A bird-wing broadhead blade may comprise a retainer portion, such as a protrusion, extension or recess for positively locating a retainer. For example, a protrusion may be configured at the free end of a bird-wing broadhead blade to retain a band. Likewise, a curved recess may be configured along the cutting surface, preferably near the free end of the bird-wing broadhead blade, to retain a ring or loop retainer.

In one embodiment, a bird-wing broadhead blade is actuated from a retained orientation to an extended orientation by way of a spring. A spring may be configured forward or back from the fixed end of the bird-wing broadhead blades. A spring may provide a force on the bird-wing broadhead blade or blades to cause the blade to extend out, or unfold. The blades may be forced down toward the centerline of the arrow and the geometry of the blade may compress the spring as the bird-wing broadhead blade is rotated down into the retained position. A retainer feature may hold the bird-wing broadhead blades in this position until entry into an object, whereby the retainer is released and the spring forces the bird-wing broadhead blade to unfold, or extend out, thereby increasing the extended offset distance of the blades. A shape memory bird-wing blade or any other suitable blade material may be used in the spring actuated bird-wing broadhead blade.

In an exemplary embodiment, a nitinol metal is incorporated into a broadhead. nitinol is a family of alloys comprising a near equiatomic mixture of nickel and titanium. The nitinol family of alloys may also include the addition of ternary elements such as copper, chromium, cobalt, iron, vanadium, niobium, or other elemental additions. The nitinol family of alloys may also include quaternary additions of similar fourth elements. Nitinol materials can exhibit shape memory and superelastic properties due to a reversible and diffusionless phase change. The austenite phase is stable at high temperatures and has a body centered cubic lattice structure, while the low temperature phase (martensite) has a monoclinic lattice structure. Nitinol has the ability to undergo a reversible phase change due to temperature (shape memory effect) or due to the application of stress (superelastic effect). The current invention takes advantage of the superelastic behavior of nitinol to create an improved broadhead component.

The superelastic (psuedoelastic) behavior allows the material to recover a significant amount of strain due to the reversible, metallurgical phase transformations by changes in the state of stress. The metallurgical phase transformations may be isothermal metallurgical phase transformations. The superelastic behavior is characterized by a linear elastic and nonlinear pseudoelastic stress-strain response allowing the material to recover a significant amount of strain due to the reversible austenitic-martensitic phase transformation. Conventional nitinol materials can typically recover principle strains on the order of up to 8%. The superelastic effect of nitinol is demonstrated by the application of stress to the nitinol material at temperatures at which the austenite is the stable phase. The initial application of stress causes the austenitic structure to deform in the classical Hookean linear elastic manner until a critical stress is achieved. The application of stress beyond this critical stress results in a nonlinear stress-strain response due to the reversible transformation to martensite. Upon removal of the applied stress, the material can reversibly transform back to austenite, returning to its original shape. As noted previously, conventional nitinol materials can recover approximately 8% strain by this superelastic effect.

Broadheads manufactured with nitinol can therefore be forced to bend more than conventional broadhead materials, and will return to their original shape when the external force is removed due to the superelastic behavior. This behavior produces a broadhead with superior durability compared to current broadhead materials.

Nitinol materials exhibit other attributes desirable for superior broadheads. Nitinol materials can exhibit high hardness >60 Rc (Rockwell C hardness) and are thus capable of maintaining a sharp edge. In addition, nitinol materials are relatively ductile, resilient, and exhibit high toughness thus providing good resistance to chipping and fracture. Finally, nitinol materials do not contain significant amounts of iron and will not rust. Nitinol materials offer excellent corrosion resistance due to the presence of a predominantly titanium oxide surface. This combination of unique properties makes nitinol a superior material over currently available broadheads.

In one embodiment, a broadhead comprises a nitinol blade and utilizes the superelastic property to enable movement from a retained position to a set shape. This unique superelastic property along with the other superior properties of nitinol provides for a superior bird-wing blade, as described herein.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
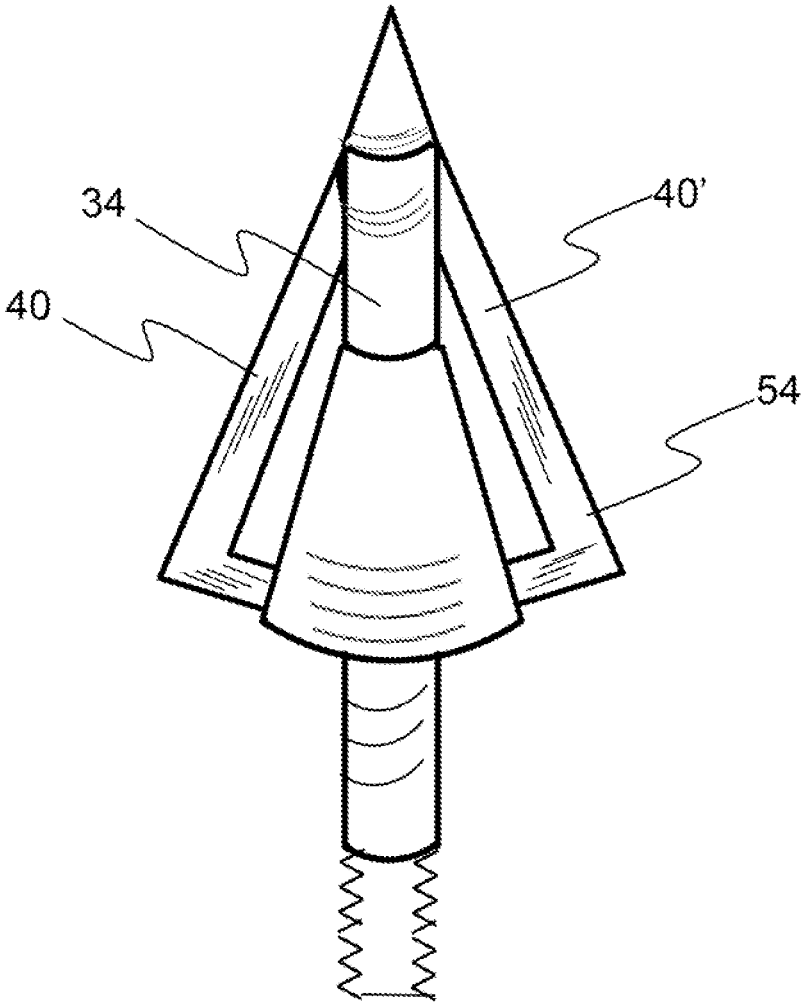

FIG. 1 shows an isometric view of a conventional fixed blade broadhead.

Figure 2A:
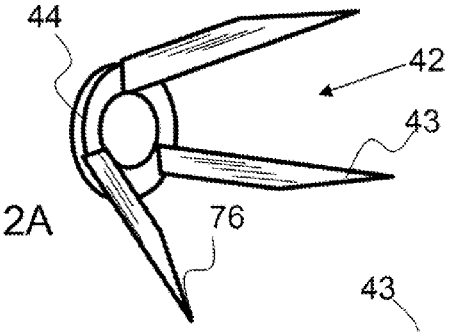

FIG. 2A show an isometric view of a conventional mechanical blade insert having three blades.

Figure 2B:
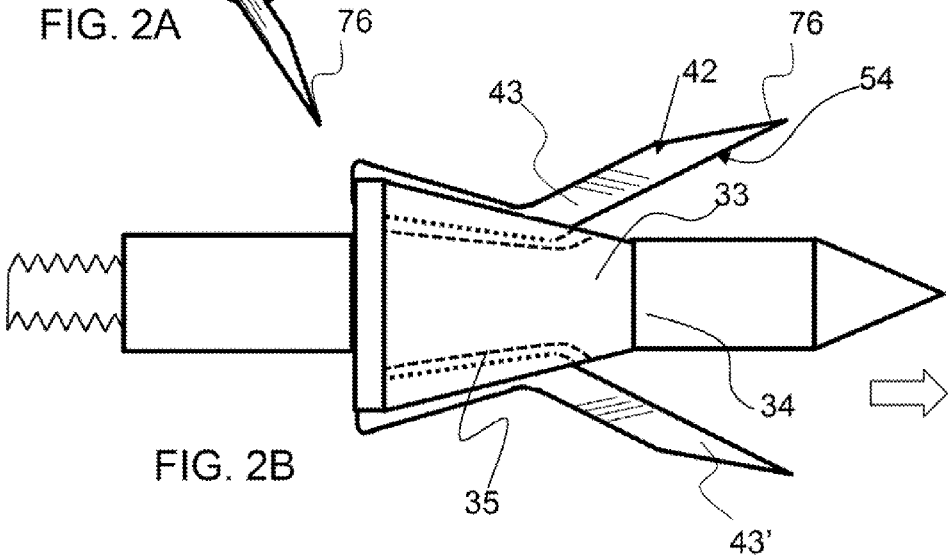

FIG. 2B shows a side view of a broadhead with a conventional mechanical blade insert configured thereon.

Figure 2C:
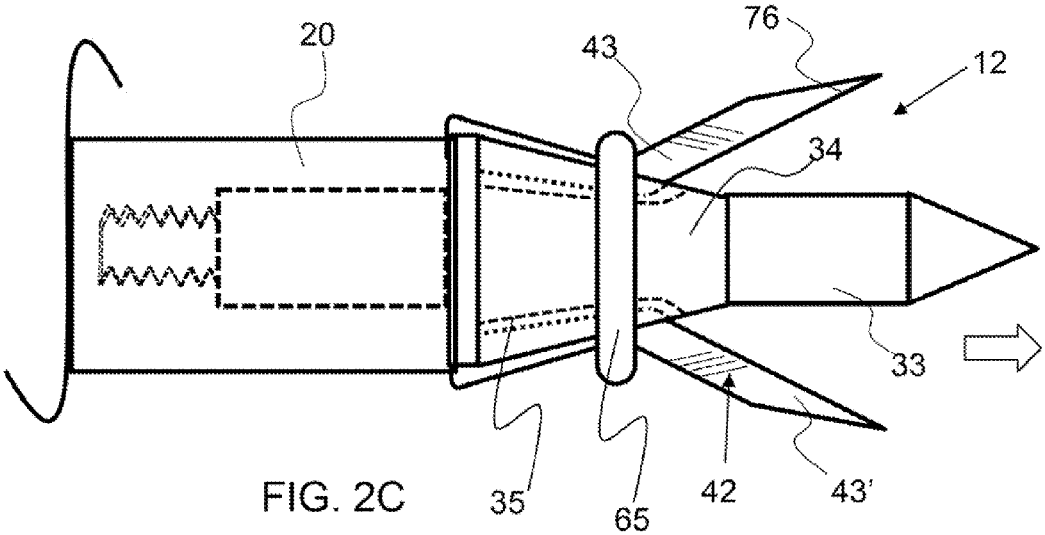

FIG. 2C shows a side view of a broadhead with a conventional mechanical blade insert configured thereon and the blades in a retained forward orientation.

Figure 2D:
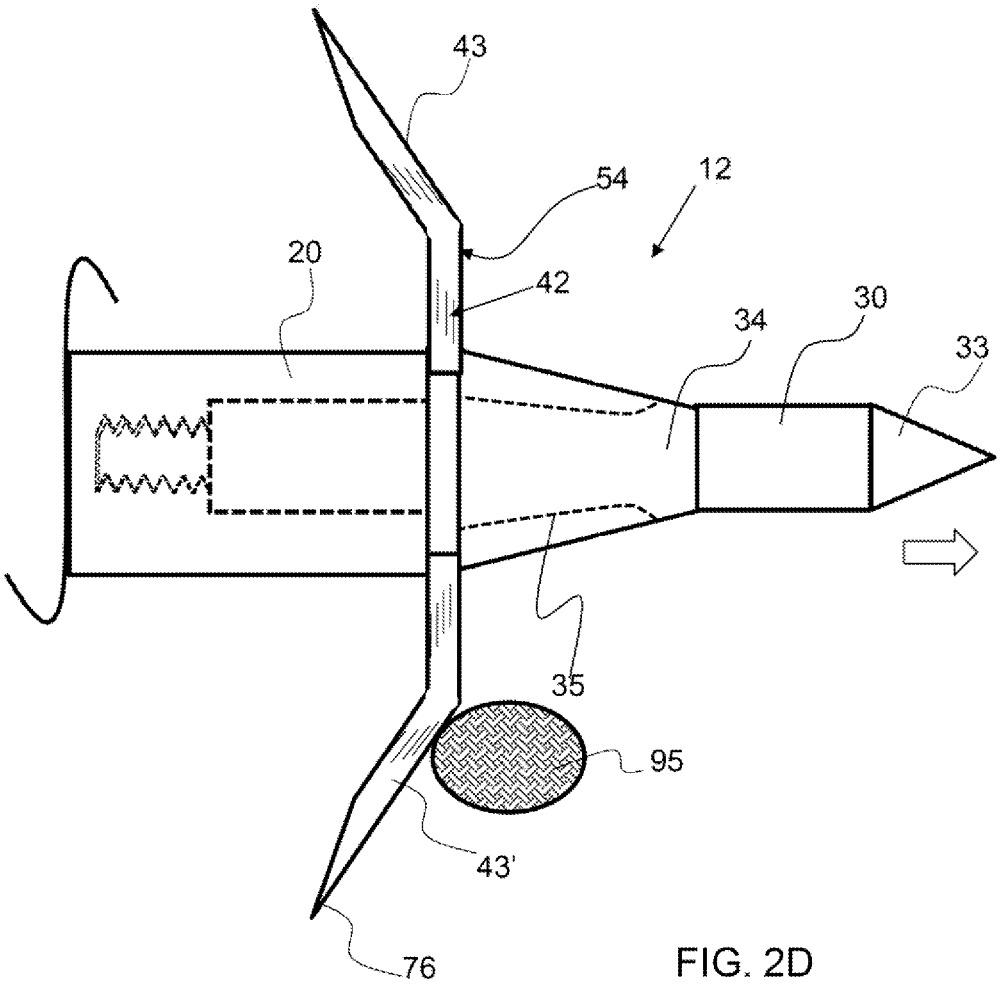

FIG. 2D shows a side view of a broadhead with a conventional mechanical blade insert configured thereon and the blades in a back or deployed orientation.

Figure 3:
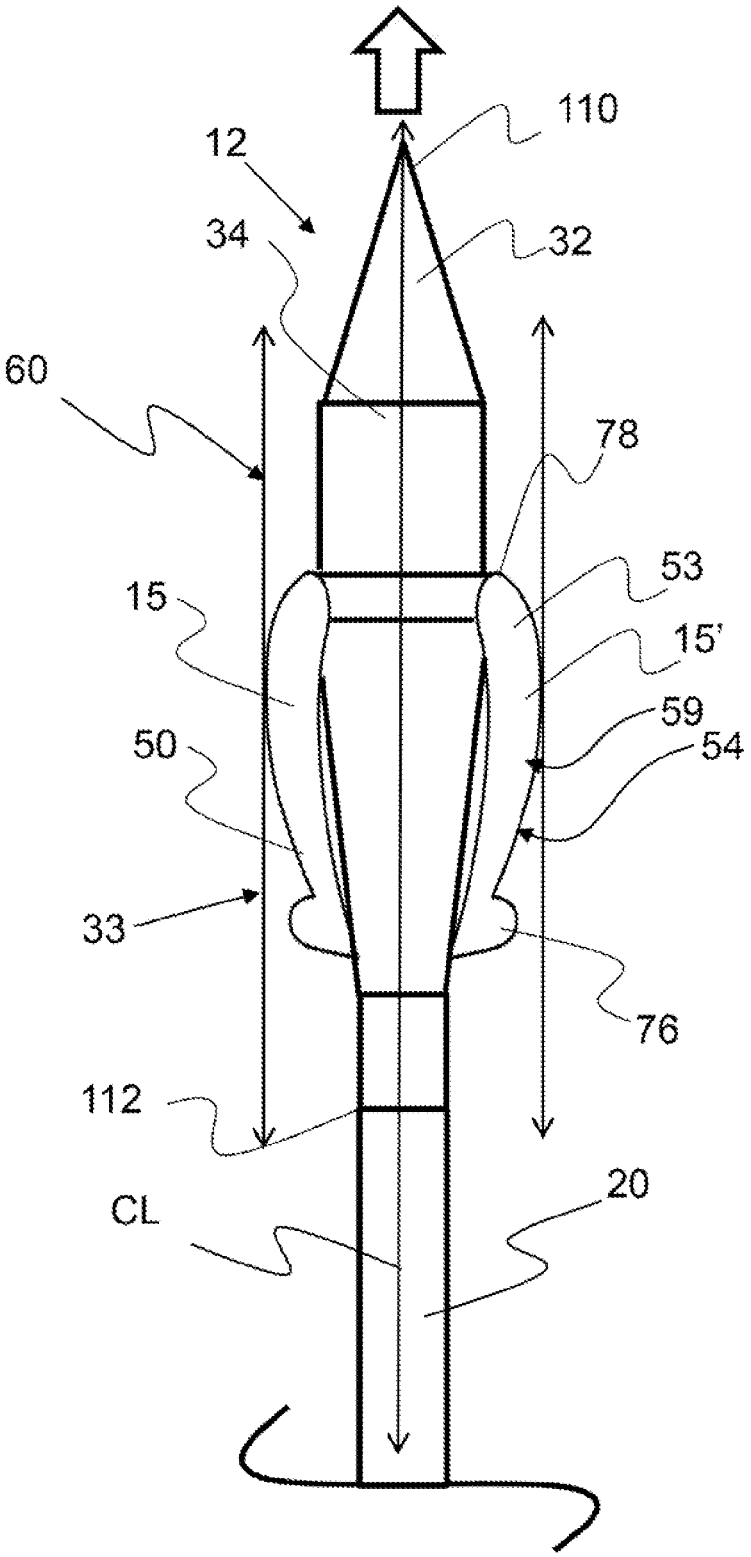

FIG. 3 shows a side view of an exemplary arrow comprising bird-wing broadhead blades in a back and retained orientation.

Figure 4:
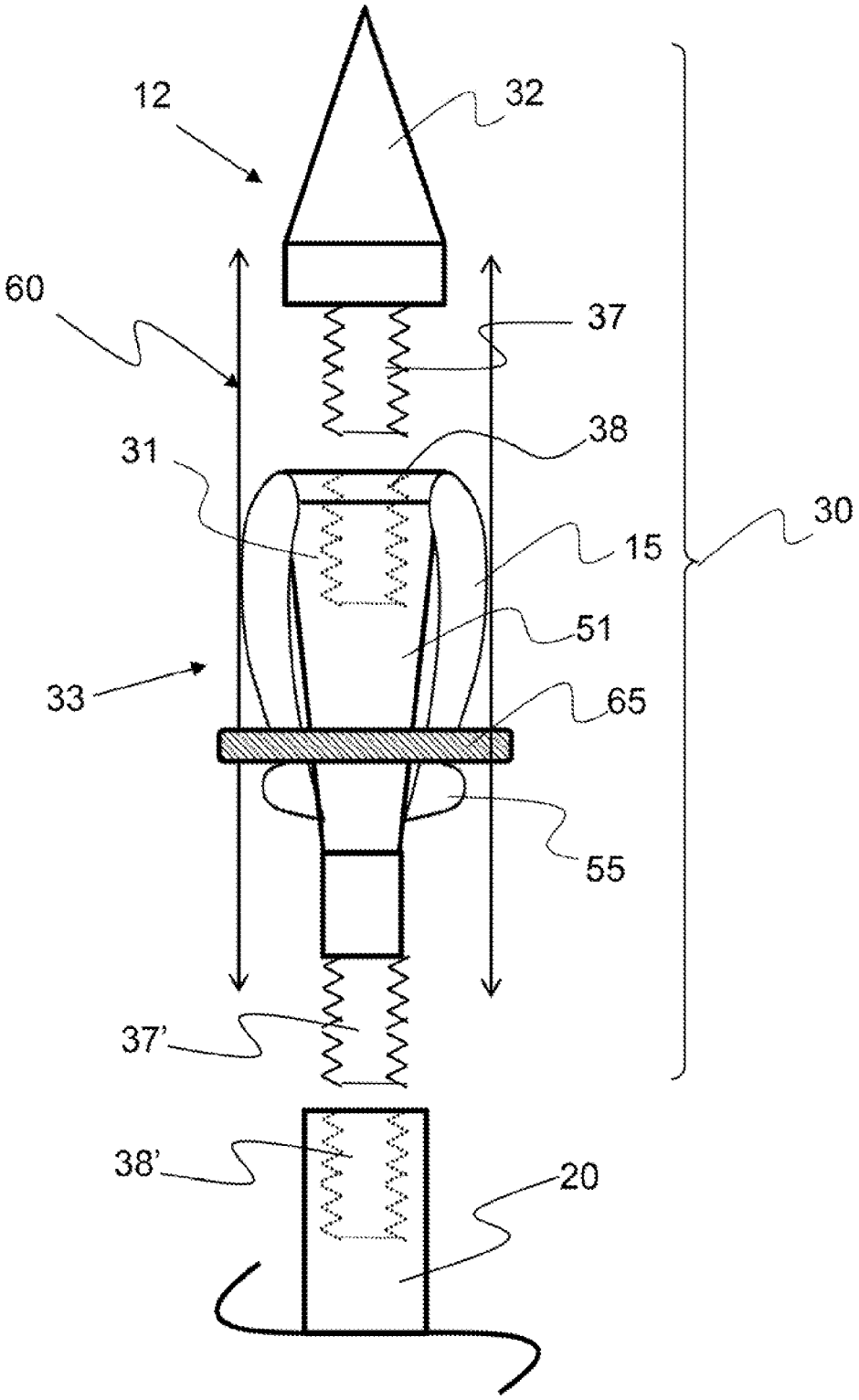

FIG. 4 shows a side view of an exemplary arrow having an arrow point, an arrow shaft and an insert comprising exemplary bird-wing blades retained by a retainer.

Figure 5:
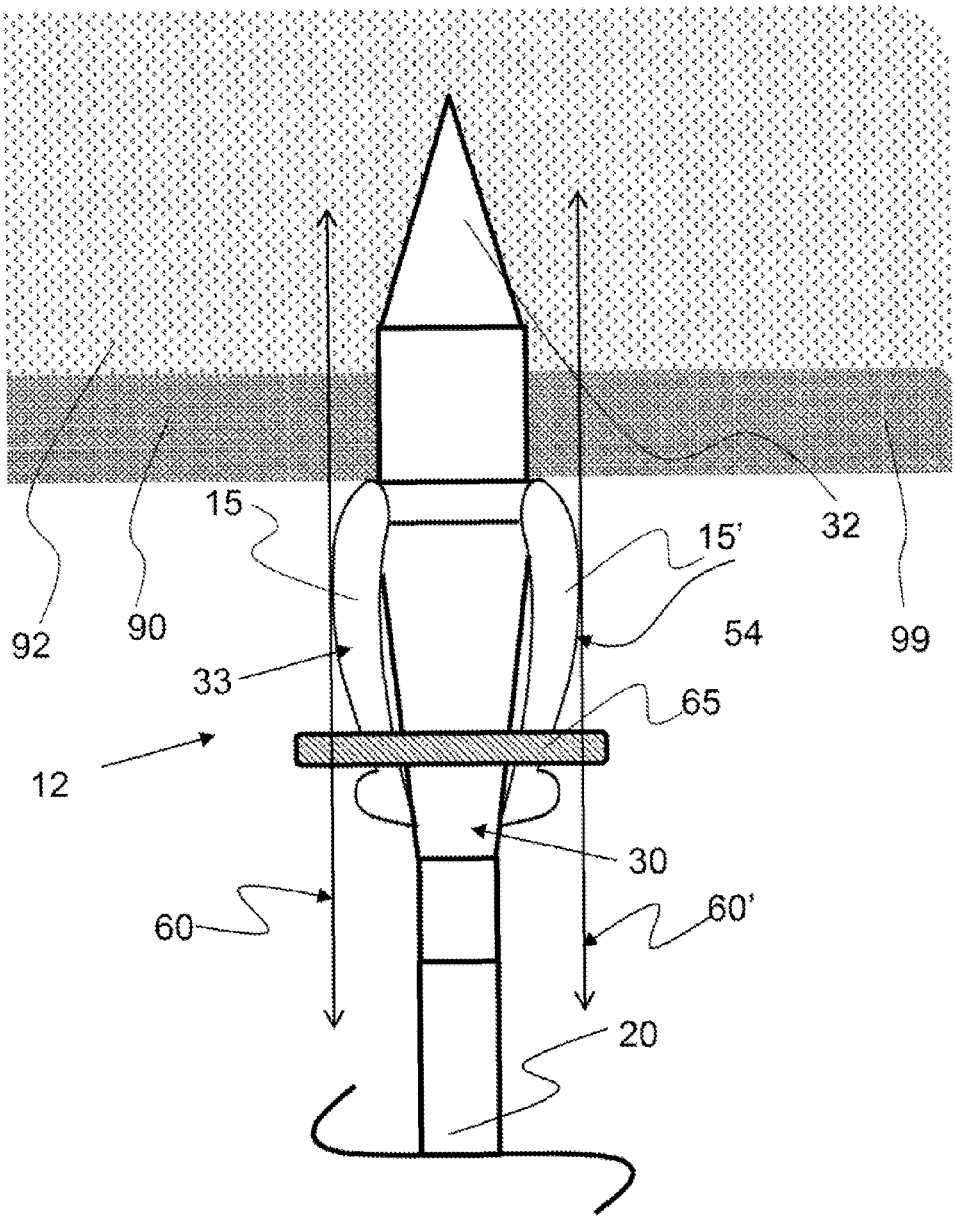

FIG. 5 shows a side view of an arrow having an exemplary bird-wing blade insert configured thereon, entering the hide of a game animal.

Figure 6:
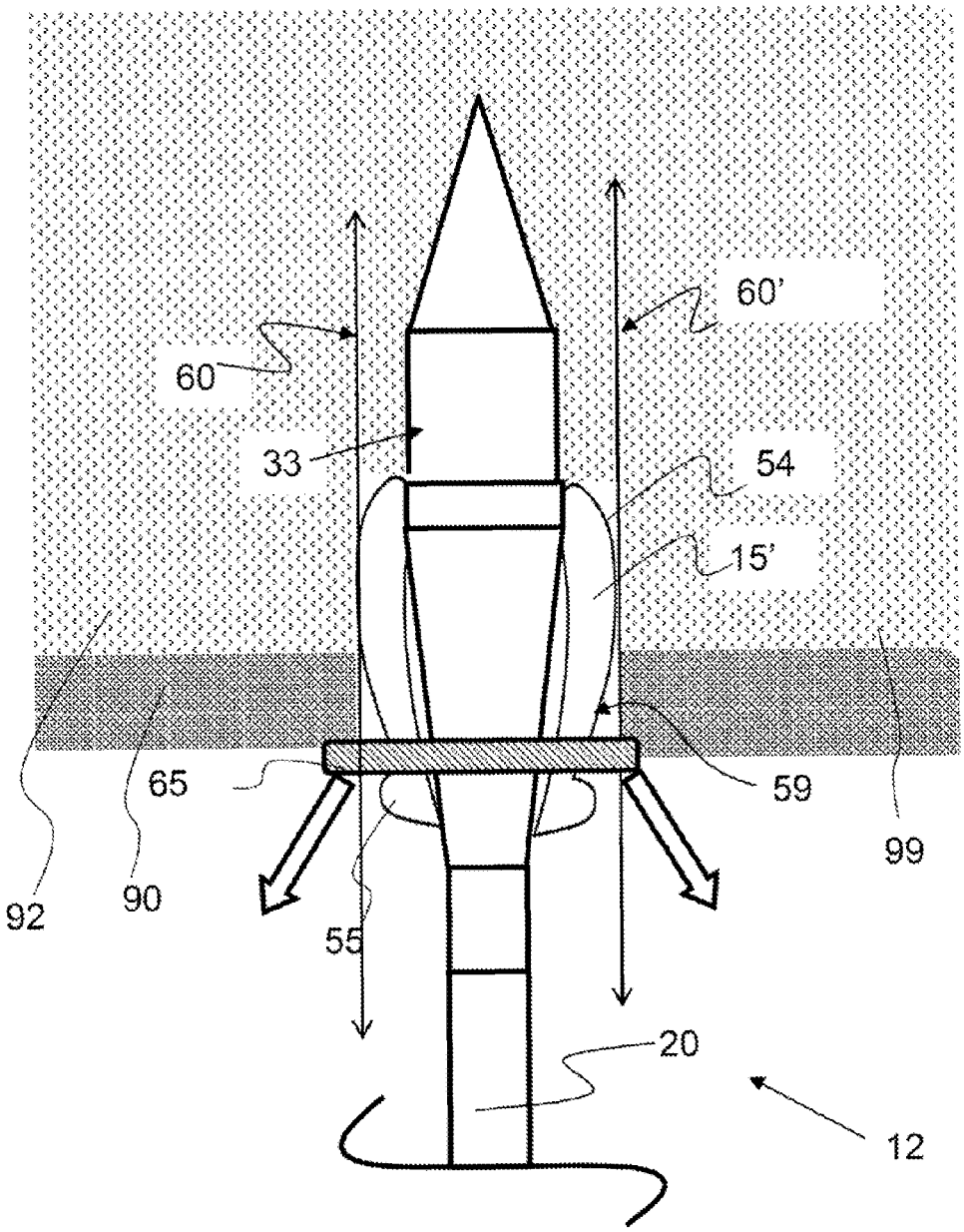

FIG. 6 shows a side view of an arrow having an exemplary bird-wing blade insert configured thereon, penetrating into the flesh of a game animal.

Figure 7:
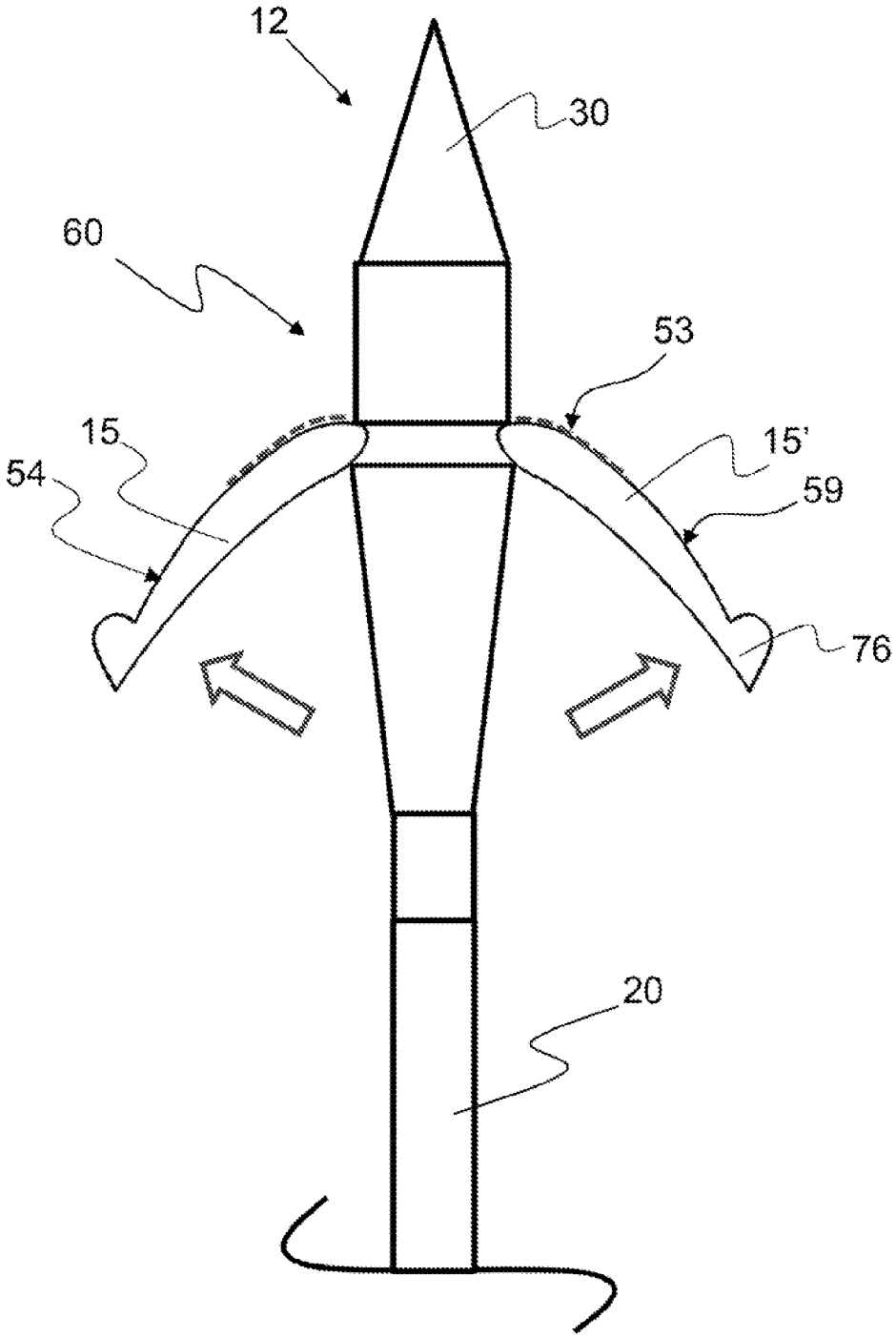

FIG. 7 shows a side view of an arrow having an exemplary bird-wing blade insert in a deployed orientation, with the free ends of the exemplary bird-wing blades extended from a back position to a more forward position.

Figure 8:
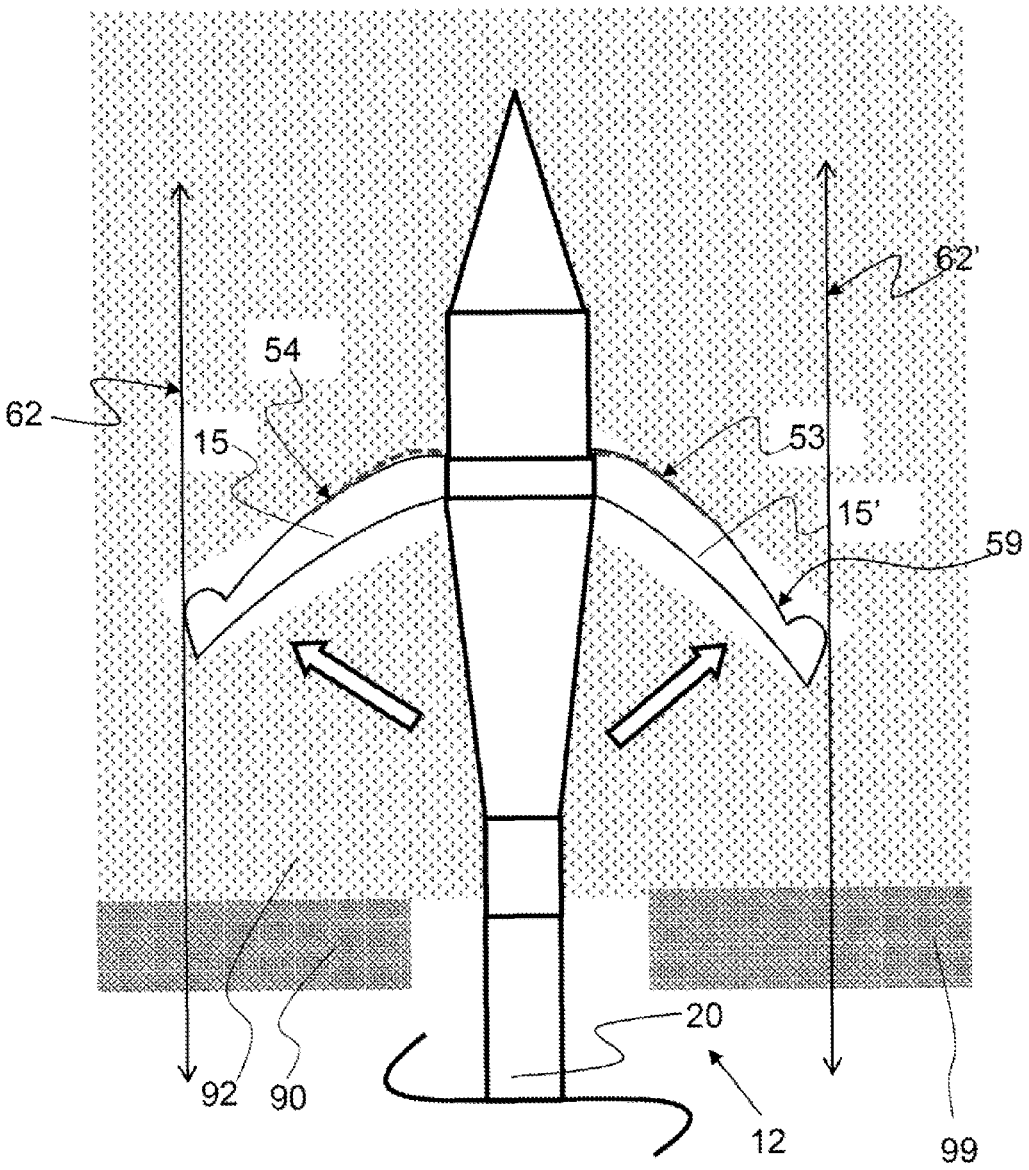

FIG. 8 shows a side view of an arrow having an exemplary bird-wing blade insert configured thereon, penetrating into the flesh of a game animal with the exemplary bird-wing blades in a deployed orientation.

Figure 9A:
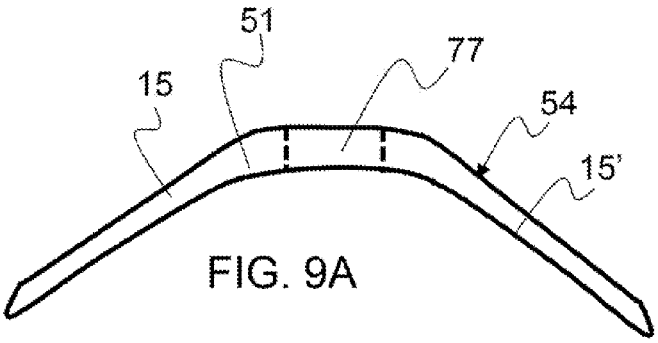

FIG. 9A shows a side view of an exemplary bird-wing blade insert having exemplary shape memory blades in a set shape.

Figure 9B:
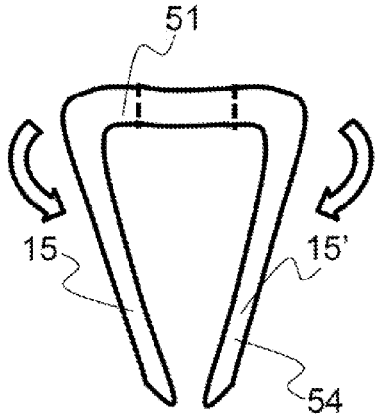

FIG. 9B shows a side view of an exemplary bird-wing blade insert having exemplary shape memory blades in a strained state, having a reversibly deformed or strained shape.

Figure 9C:
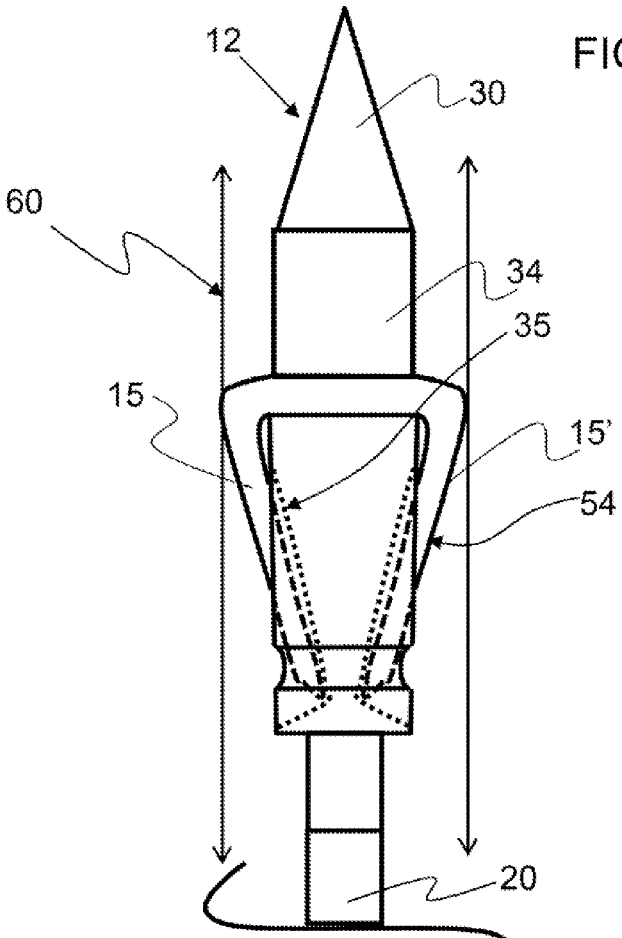

FIG. 9C shows a side view of an exemplary bird-wing blade insert having exemplary bird-wing blades in a strained state, or strained shape and retained on a broadhead arrow.

Figure 9D:
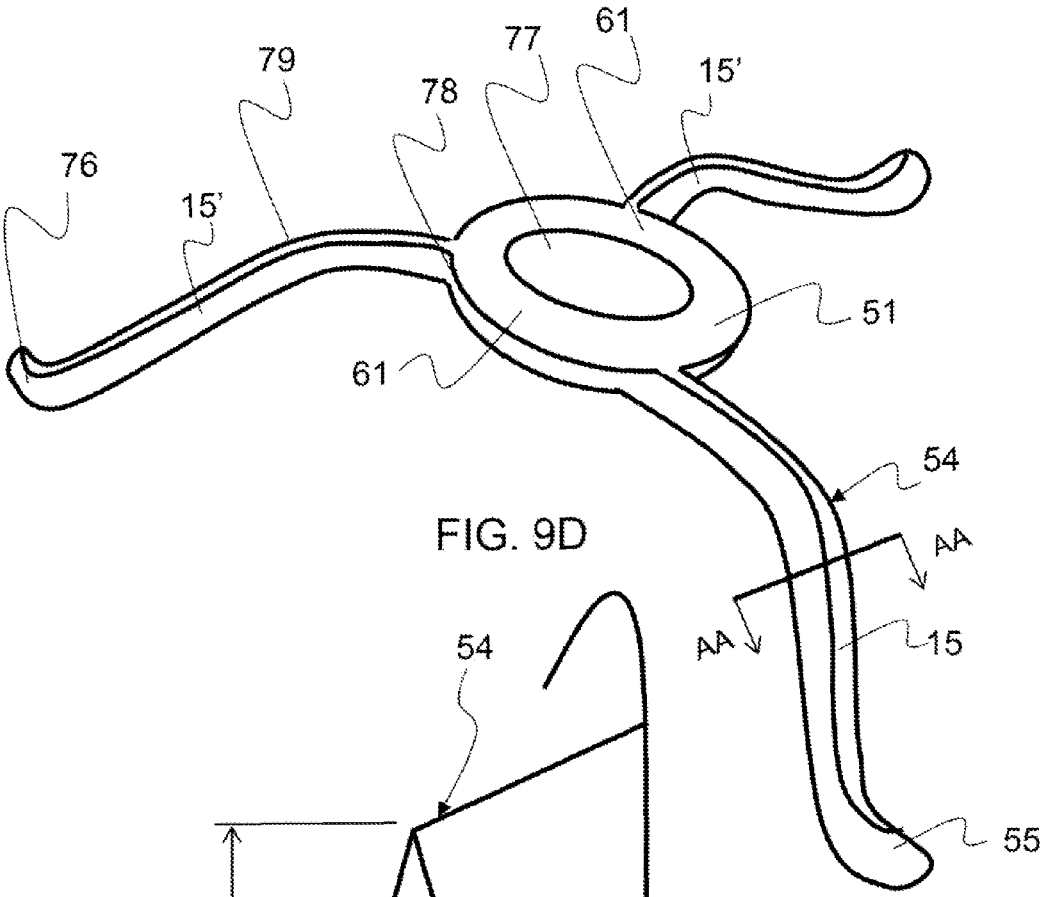

FIG. 9D shows an isometric view of an exemplary bird-wing blade insert having exemplary shape memory blades in a set shape.

Figure 9E:
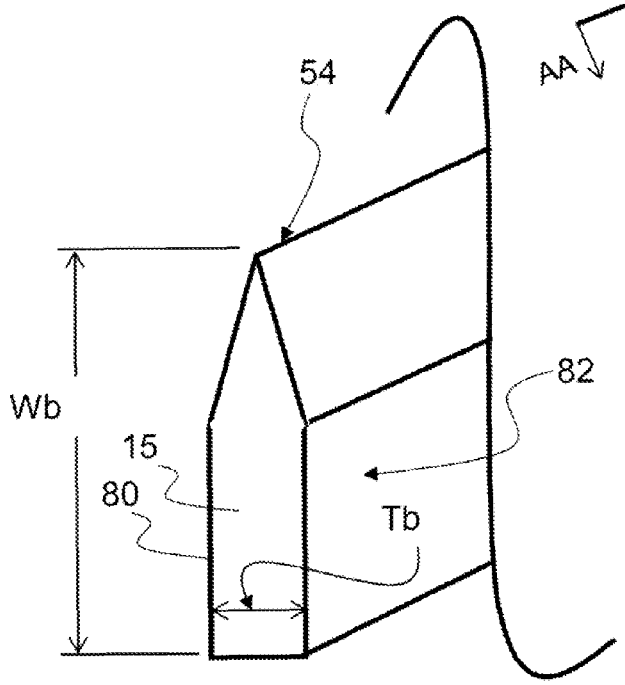

FIG. 9E shows an isometric view cross-sectional view of an exemplary shape memory blade as viewed along line AA in FIG. 9D.

Figure 10:
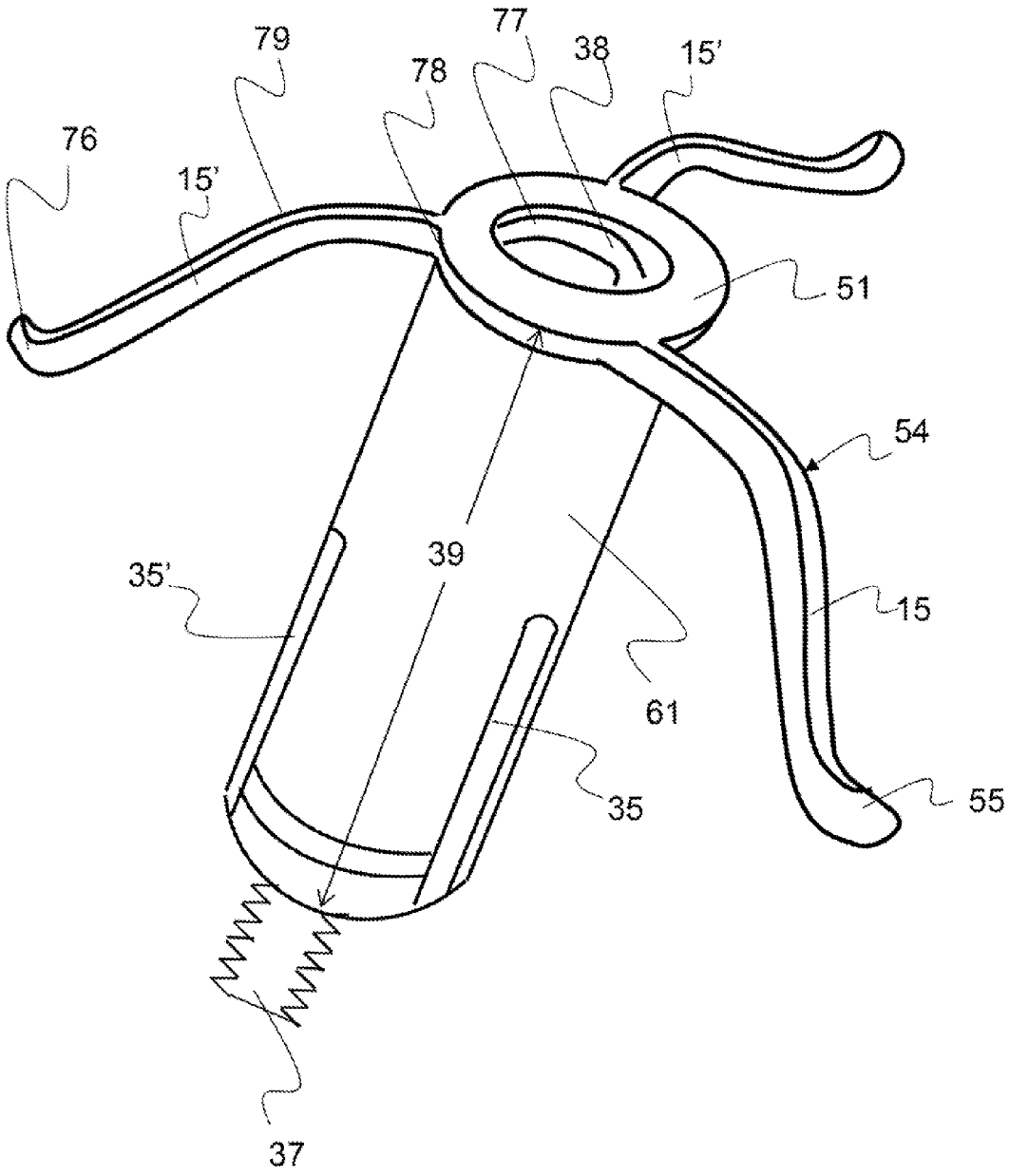

FIG. 10 shows an isometric view of an exemplary bird-wing blade insert having exemplary shape memory type bird wing blades in a set shape and an insert body having slots for positioning blades in a strained state or shape.

Figure 11:
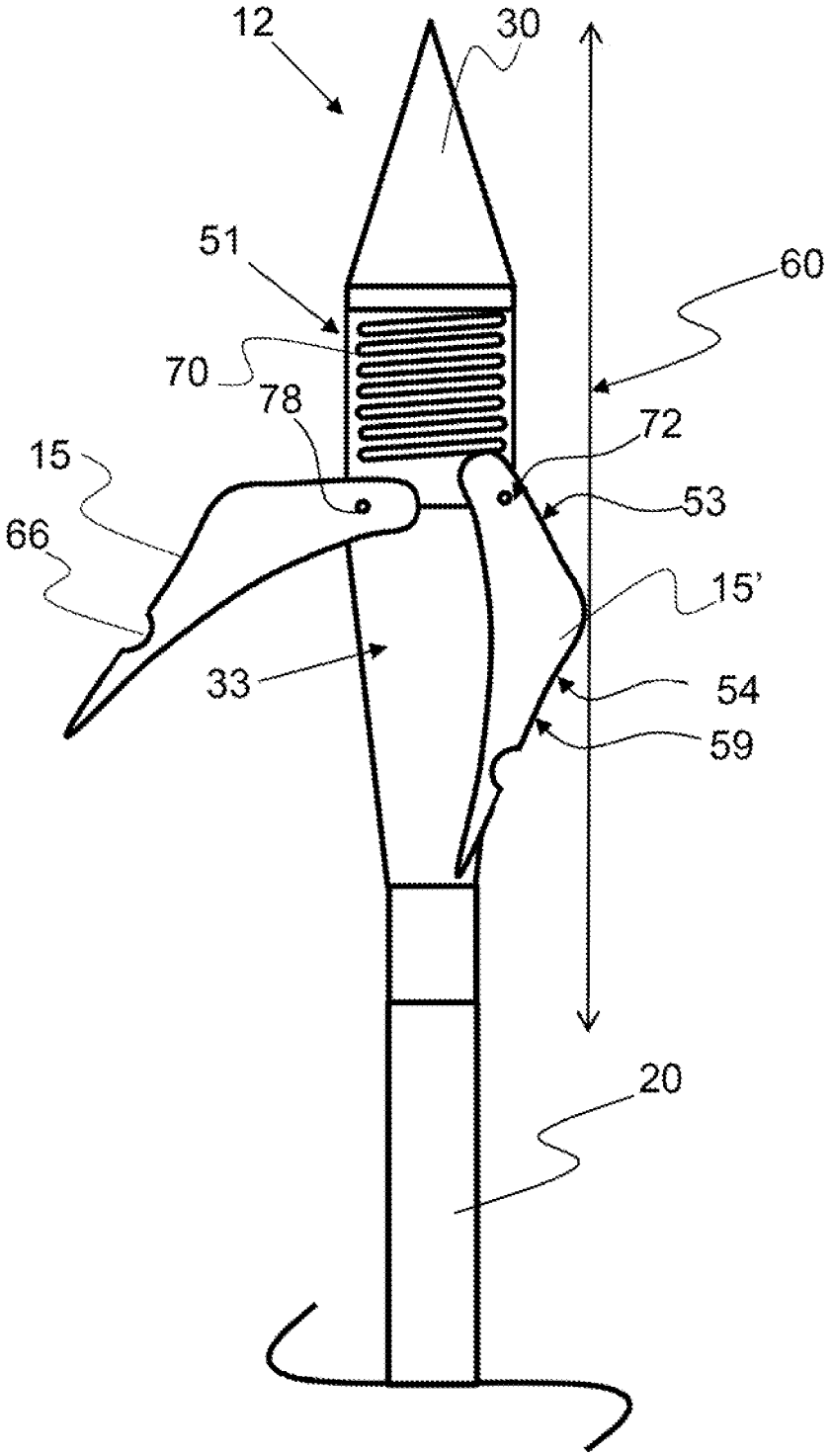

FIG. 11 shows a side cross-sectional view of an exemplary bird-wing blade insert having spring actuated blades.

Figure 12:
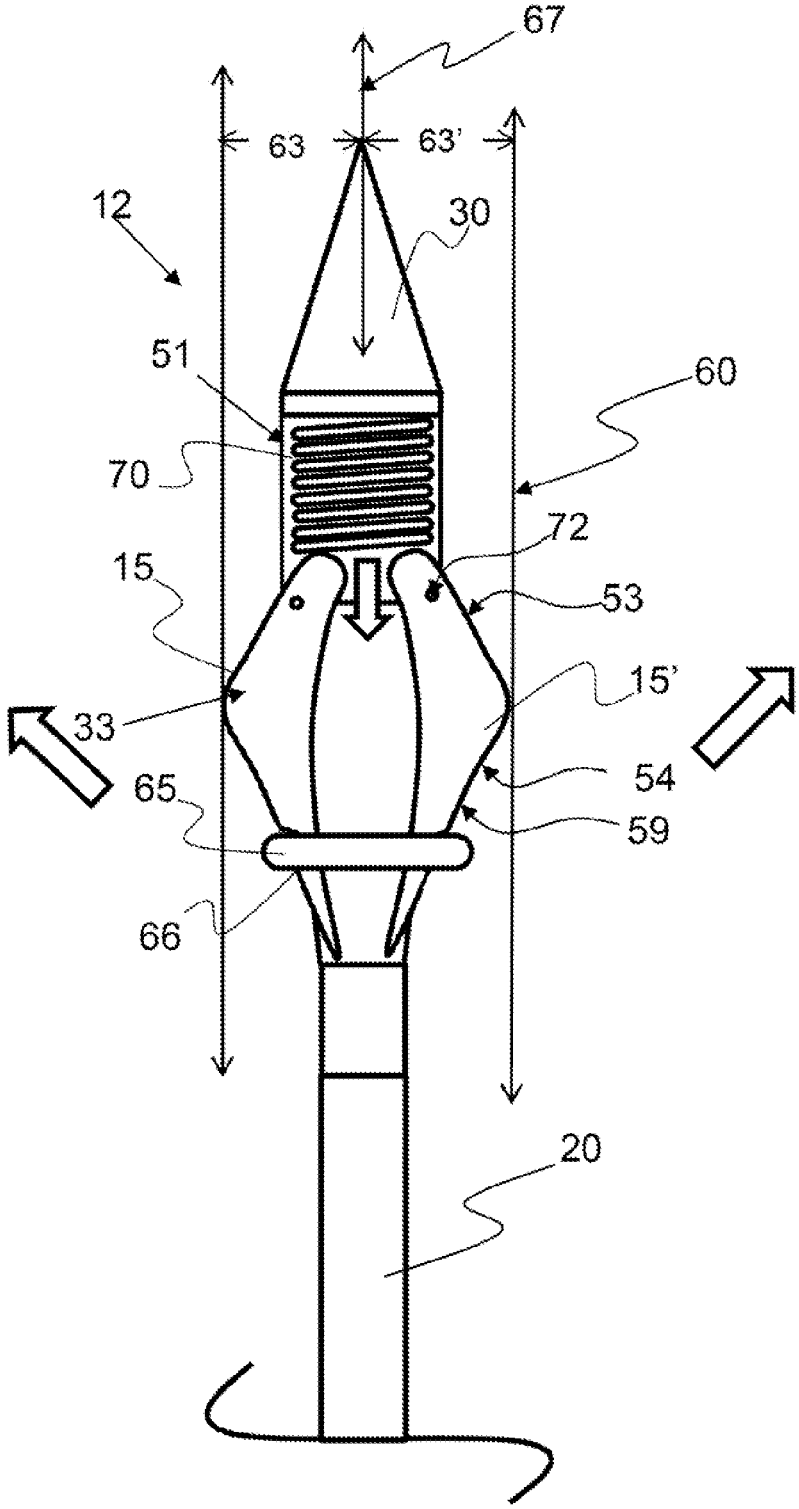

FIG. 12 shows a side cross-sectional view of an exemplary bird-wing blade insert having spring actuated blades in a back and retained position, with the spring compressed.

Figure 13:
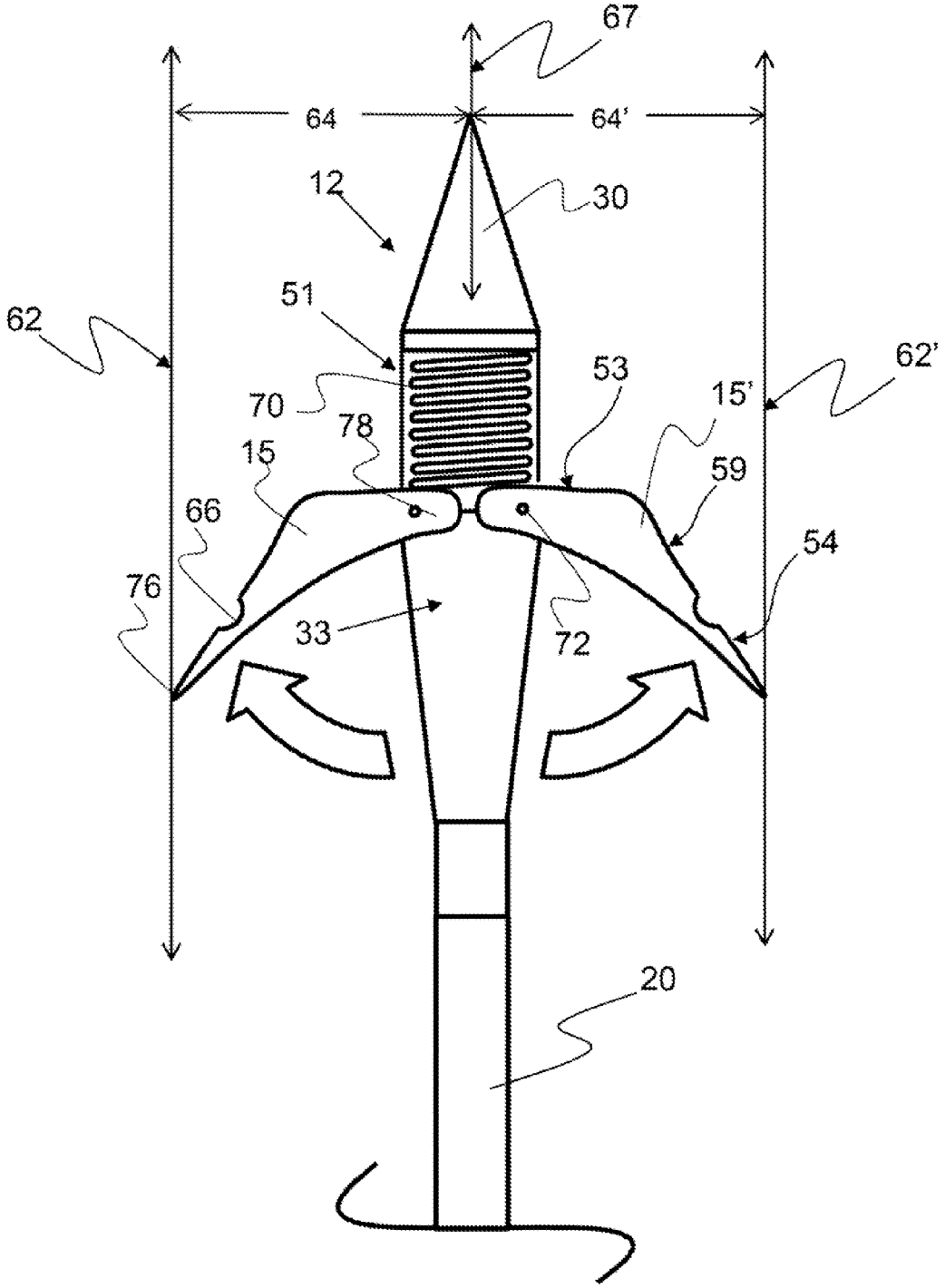

FIG. 13 shows a side cross-sectional view of an exemplary bird-wing blade insert having spring actuated blades in a forward and deployed orientation.

Figure 14:
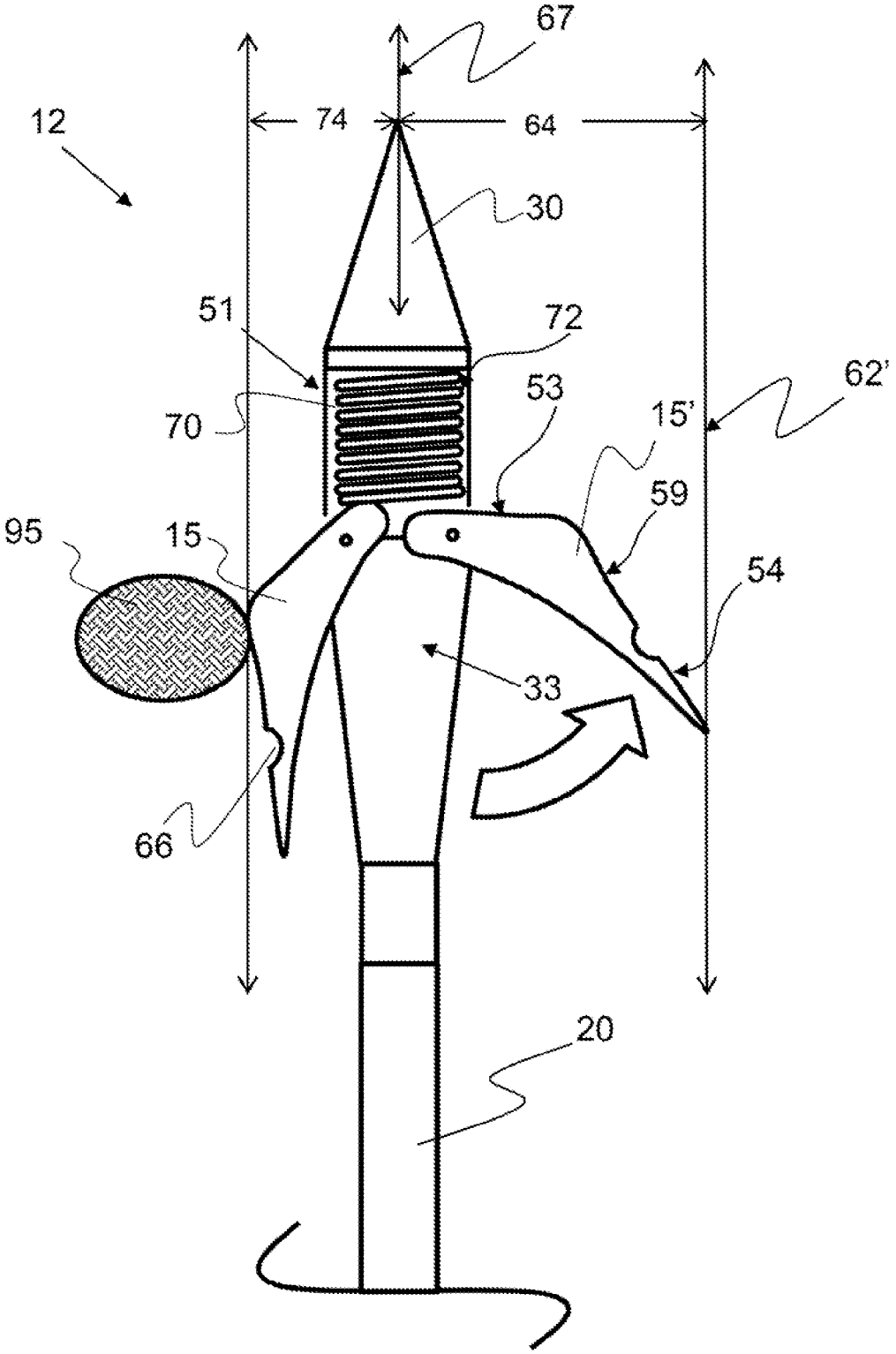

FIG. 14 shows a side cross-sectional view of an exemplary bird-wing blade insert having spring actuated blades, wherein one blade is in a forward and deployed orientation and the other is compressed back due to hitting an object.

Figure 15:
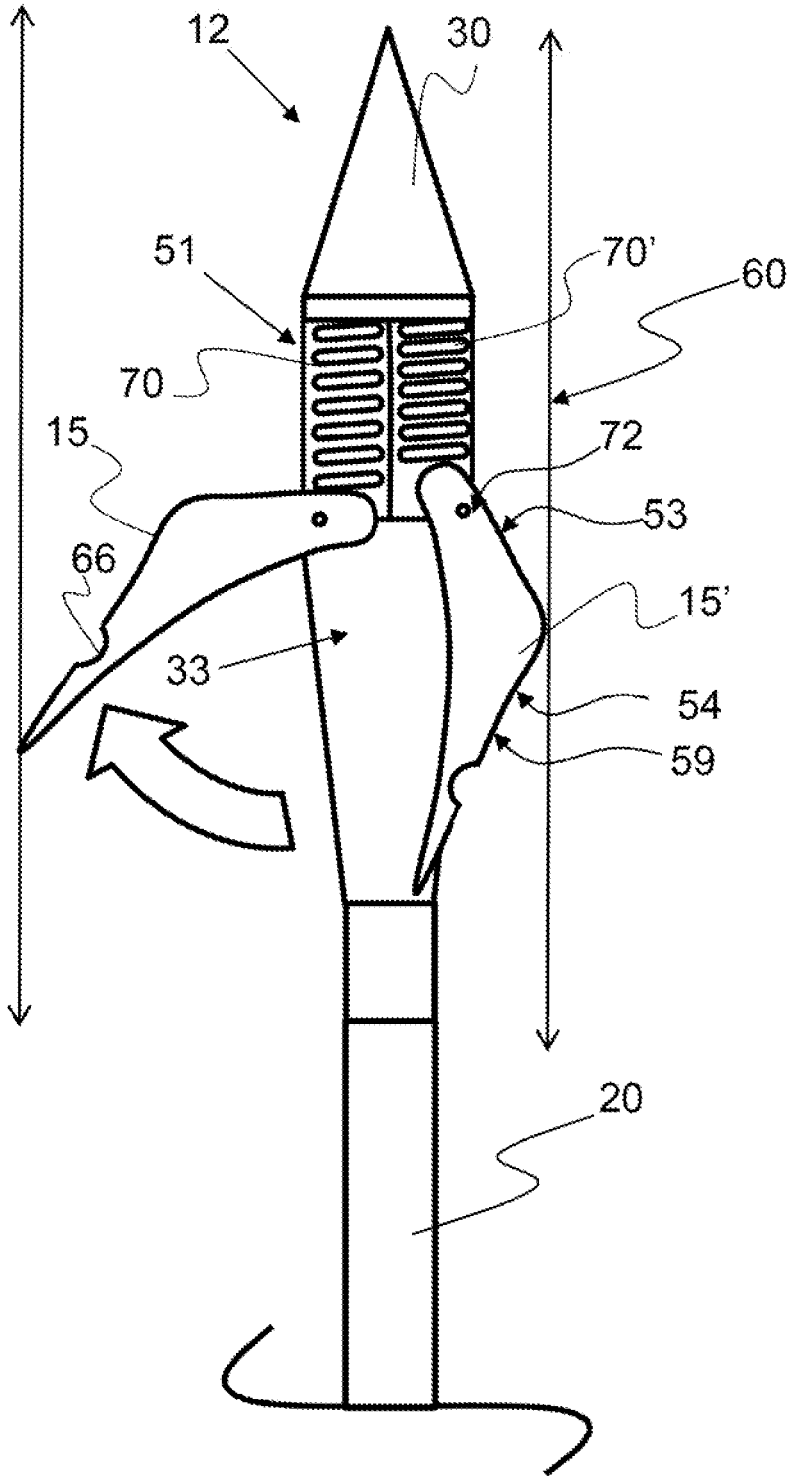

FIG. 15 shows a side cross-sectional view of an exemplary bird-wing blade insert having discrete spring actuated blades, wherein each blade has a corresponding and separate spring for actuation.

Figure 16:
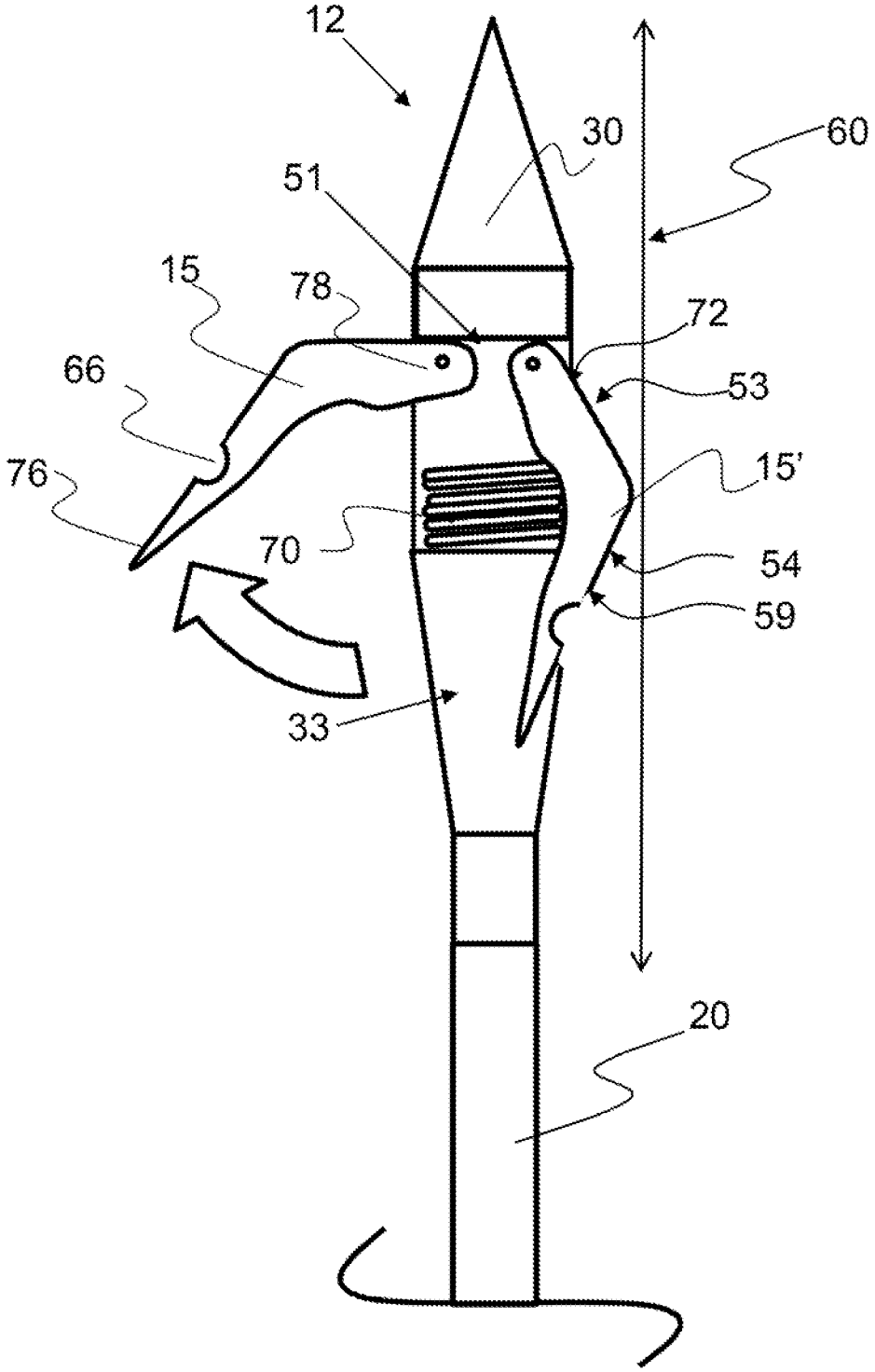

FIG. 16 shows a side cross-sectional view of an exemplary bird-wing blade insert having spring actuated blades and a spring configured downstream of the fixed end of the blades.

Figure 17:
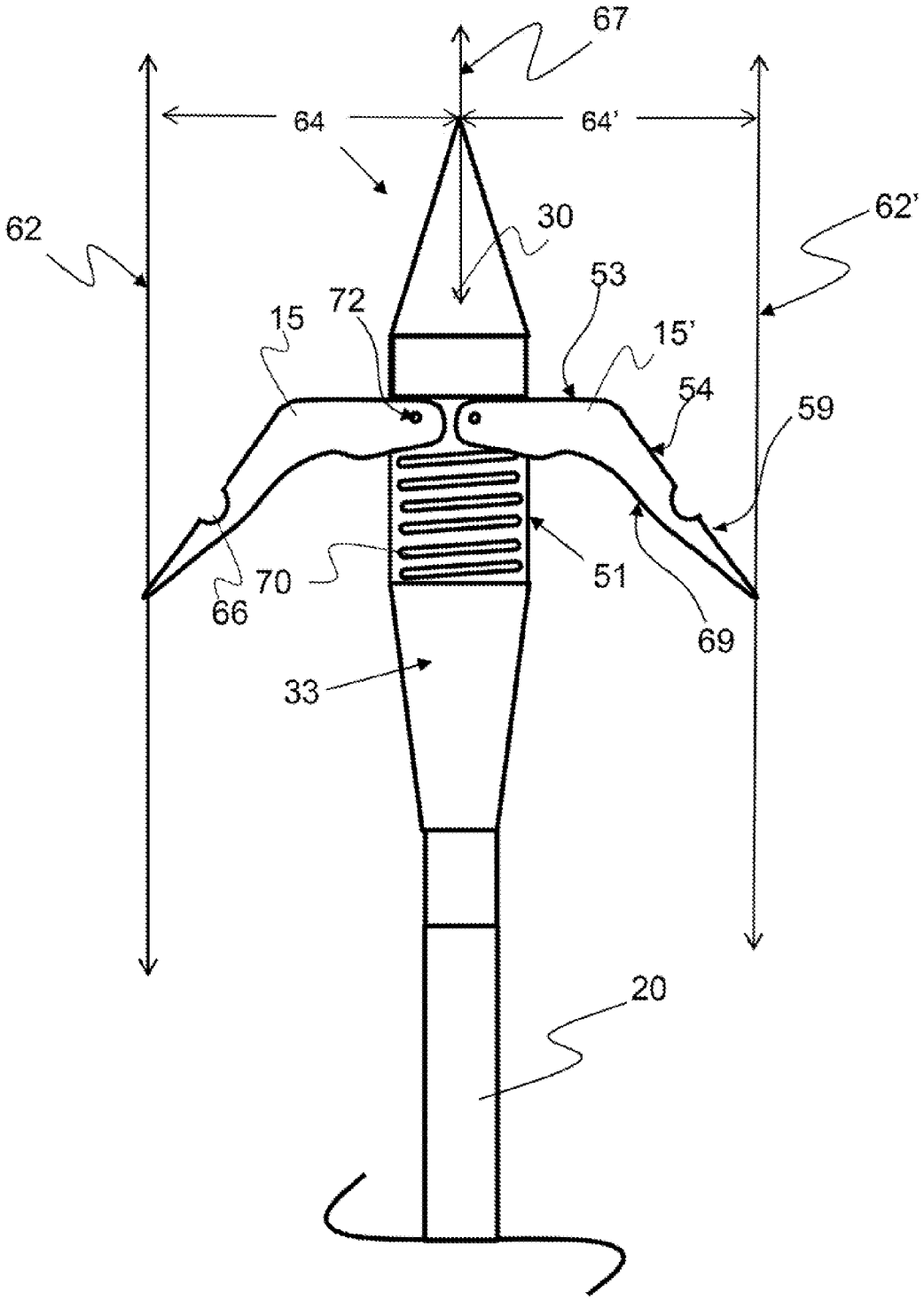

FIG. 17 shows a side cross-sectional view of an exemplary bird-wing blade insert having spring actuated blades in a forward and deployed orientation.

Figure 18:
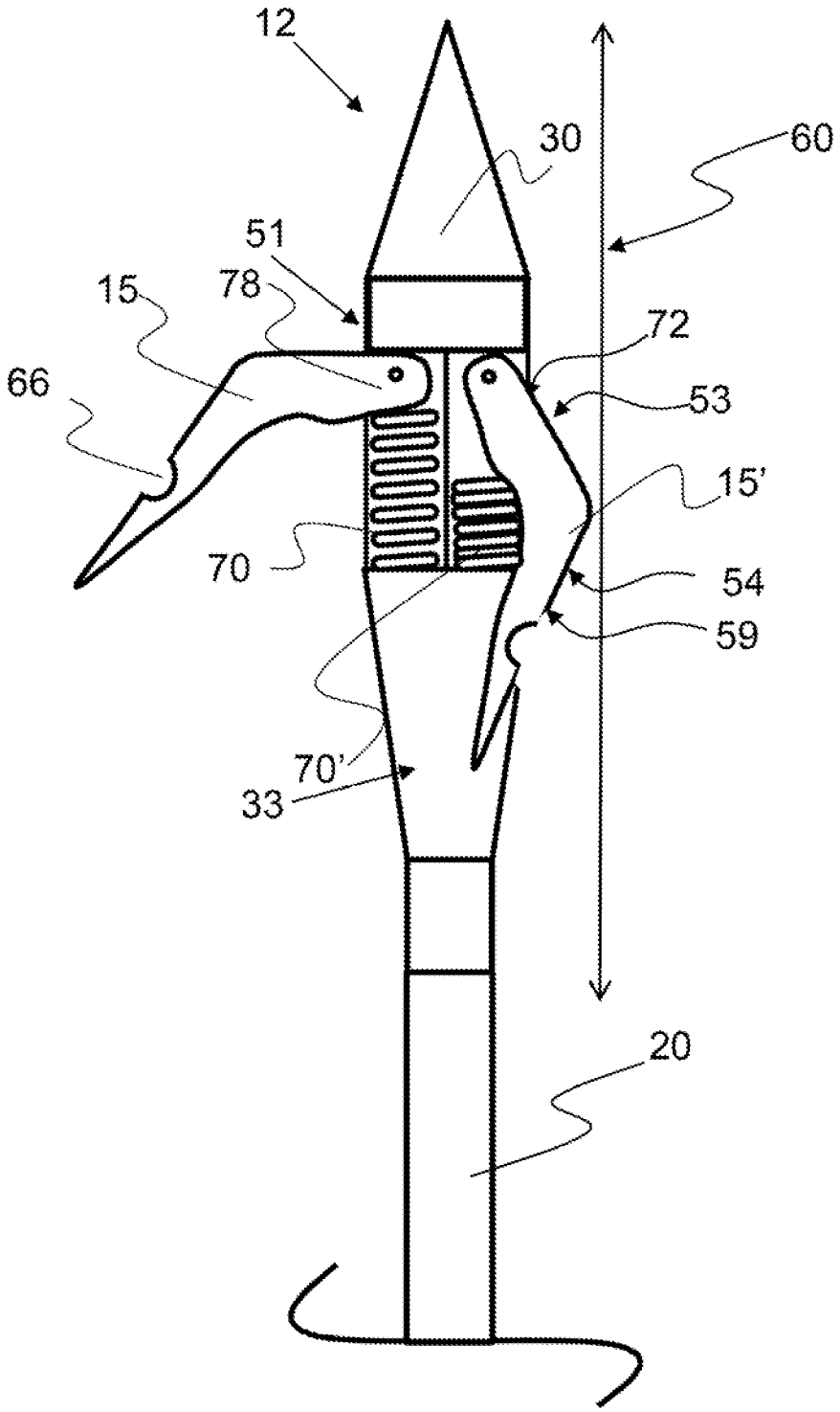

FIG. 18 shows a side cross-sectional view of an exemplary bird-wing blade insert having discrete spring actuated blades, wherein each blade has a corresponding and separate spring for actuation.

Figure 19A:
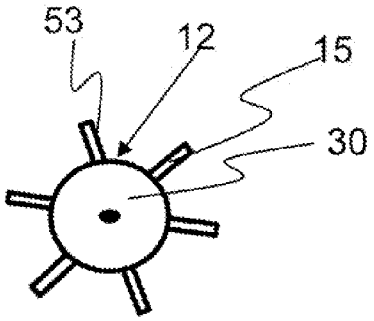

FIG. 19A shows a forward back view of an exemplary arrow having six birding blades in a retained configuration.

Figure 19B:
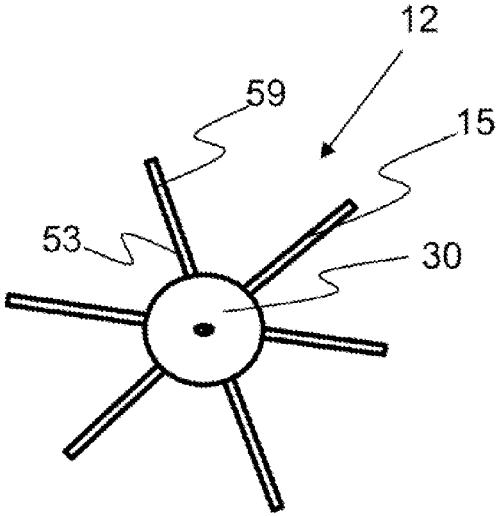

FIG. 19B shows a forward back view of the exemplary arrow shown in FIG. 19A with the six birding blades in an extended configuration.

Figure 20:
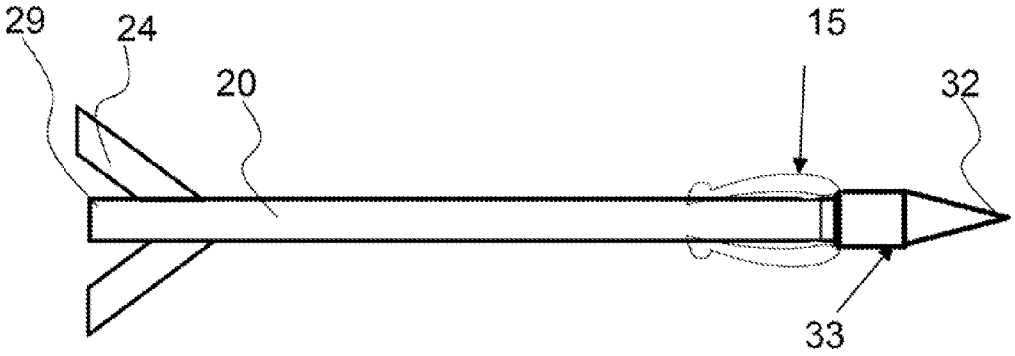

FIG. 20 shows a side view of an exemplary arrow having an arrow point, shaft, blades, fletches and an arrow end.

Figure 21A:
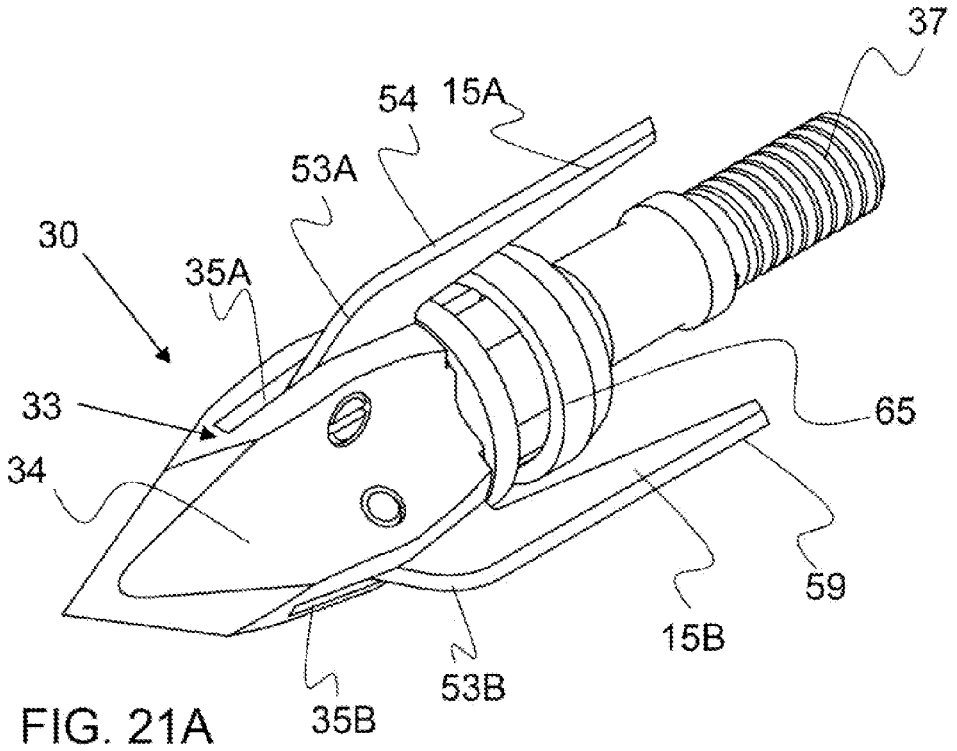

FIG. 21A shows an isometric view of an exemplary arrowhead having exemplary bird-wing blades in a retained configuration with the extended ends of the blades in a back orientation.

Figure 21B:
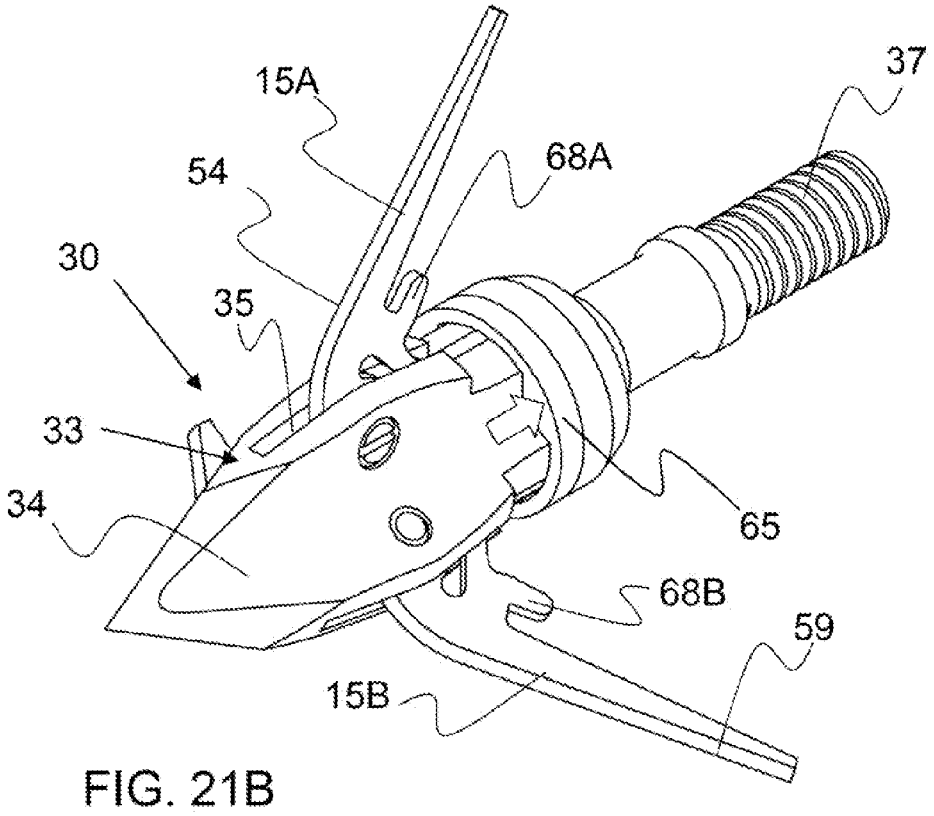

FIG. 21B shows an isometric view of the exemplary arrowhead shown in FIG. 21A with the exemplary bird-wing blades in an extended configuration.

Figure 22A:
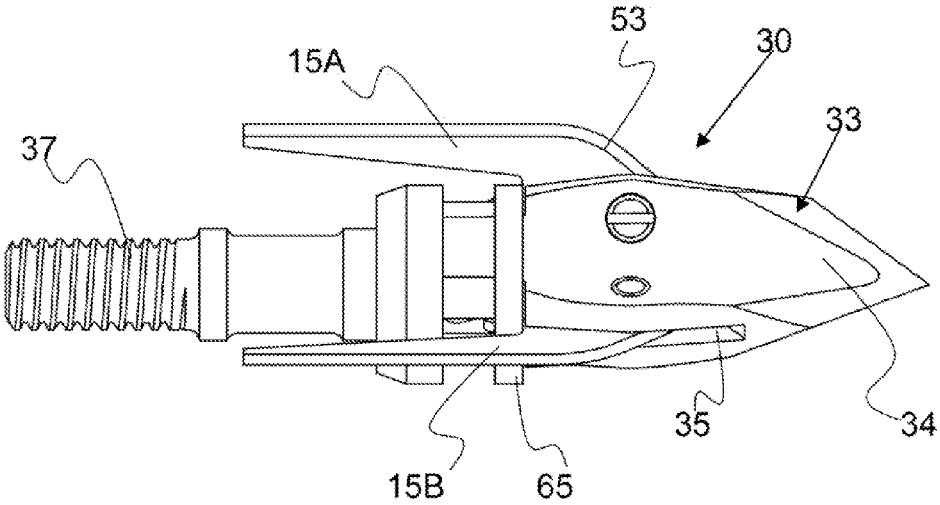

FIG. 22A shows a side view of an exemplary arrowhead having exemplary bird-wing blades in a retained configuration.

Figure 22B:
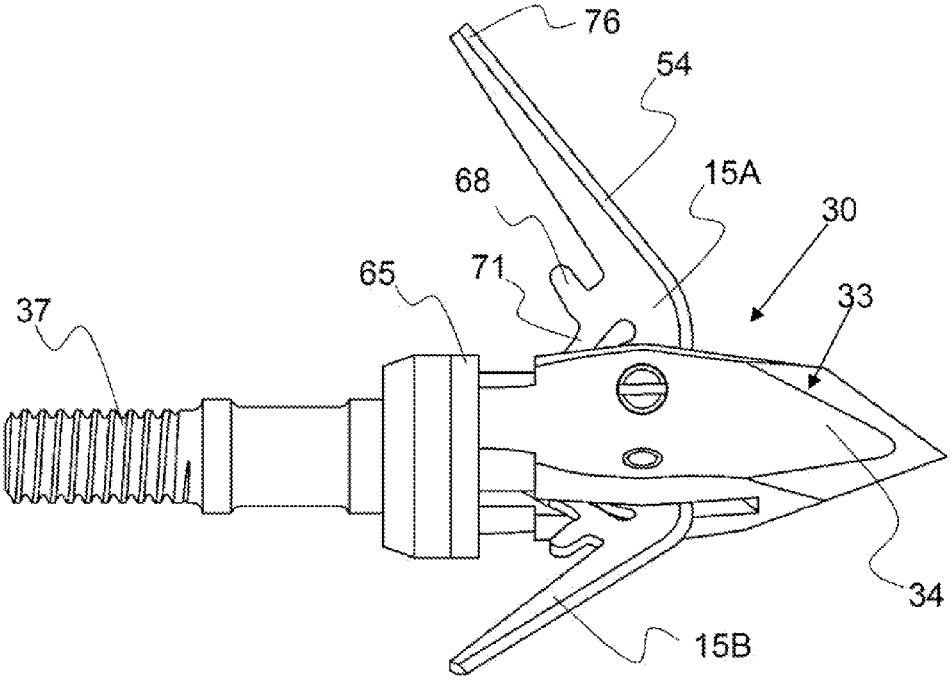

FIG. 22B shows a side view of the exemplary arrowhead shown in FIG. 22A with the exemplary bird-wing blades in an extended configuration.

Figure 23A:
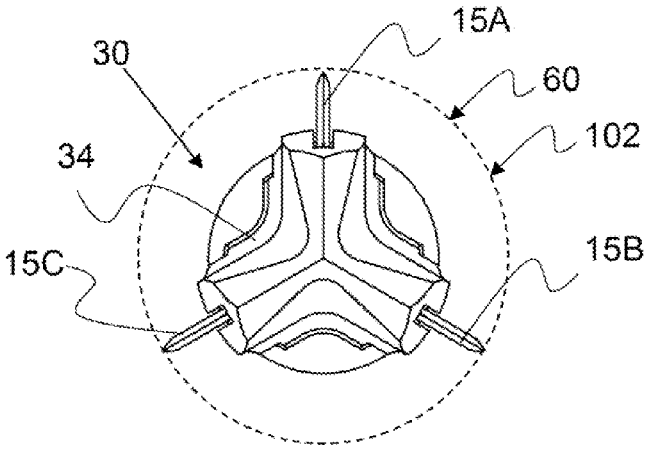

FIG. 23A shows a back-end view of an exemplary arrowhead having exemplary bird-wing blades in a retained configuration. The entry diameter of the arrowhead is shown in a dashed line around the arrowhead.

Figure 23B:
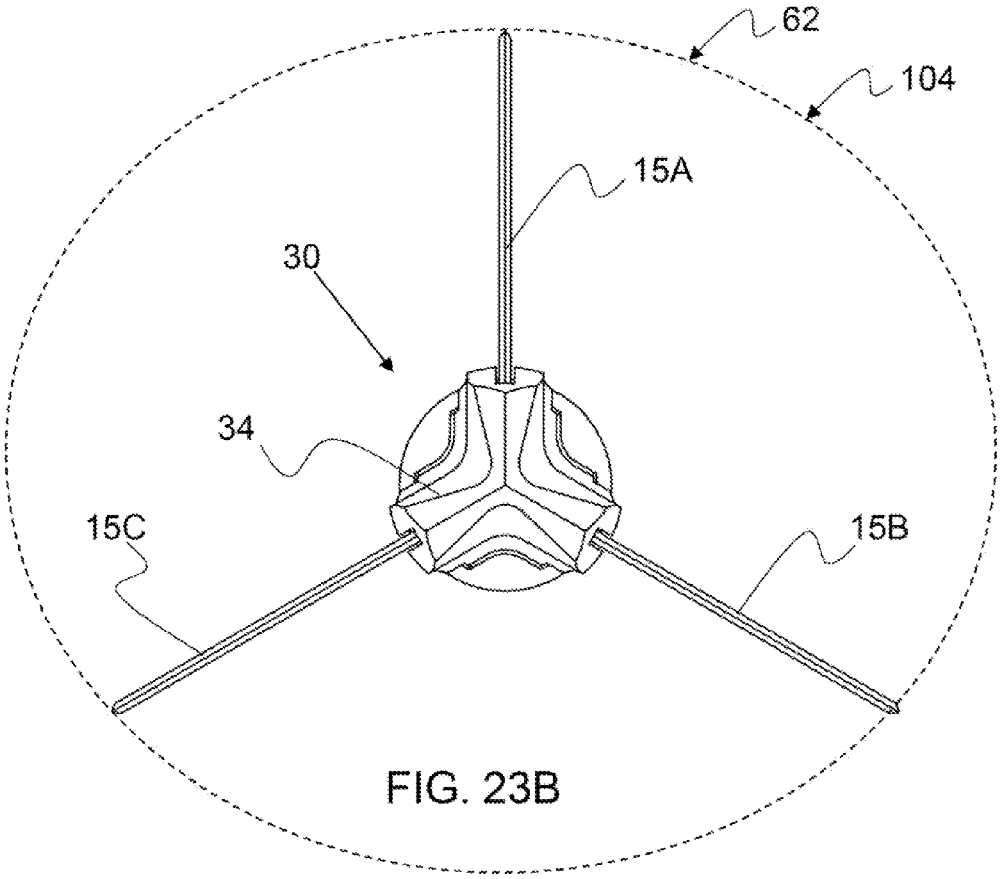

FIG. 23B shows a back-end view of the exemplary arrowhead shown in FIG. 23A with the exemplary bird-wing blades in an extended configuration. The extended diameter of the arrowhead is shown in a dashed line around the arrowhead.

Figure 24:
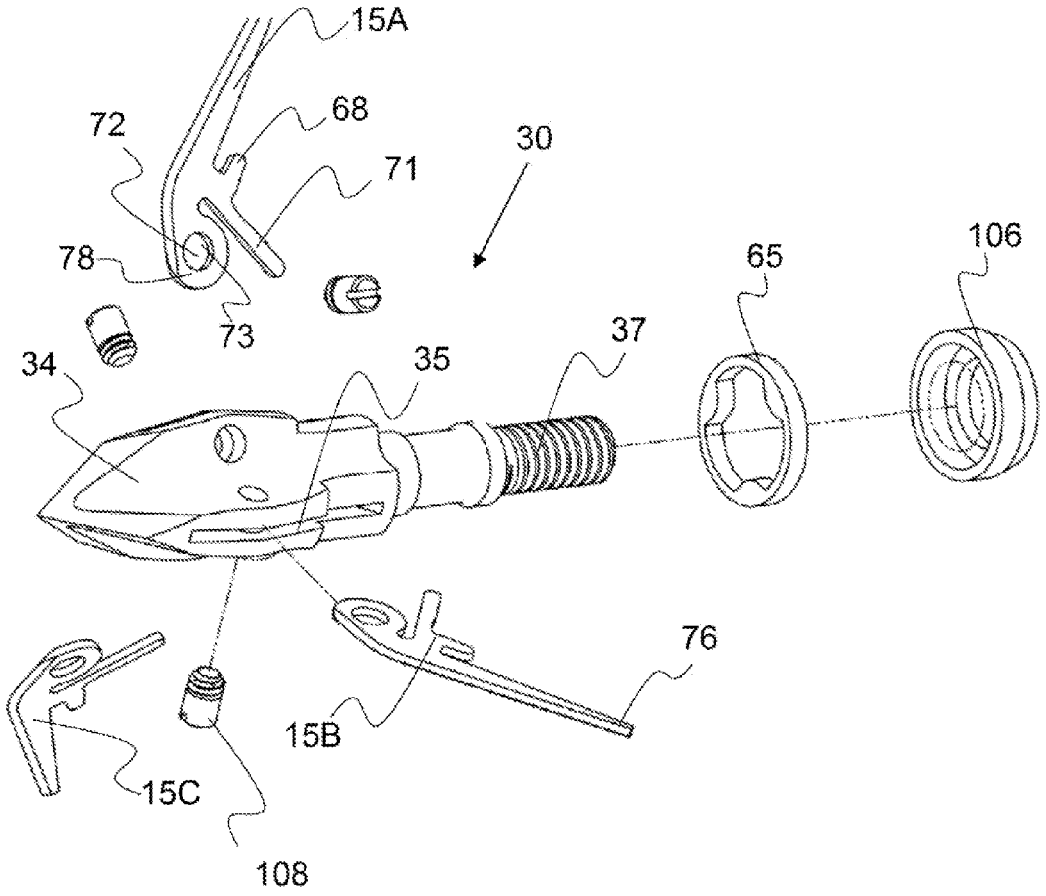

FIG. 24 shows an isometric exploded view of an exemplary bird-wing arrowhead.

Figure 25A:
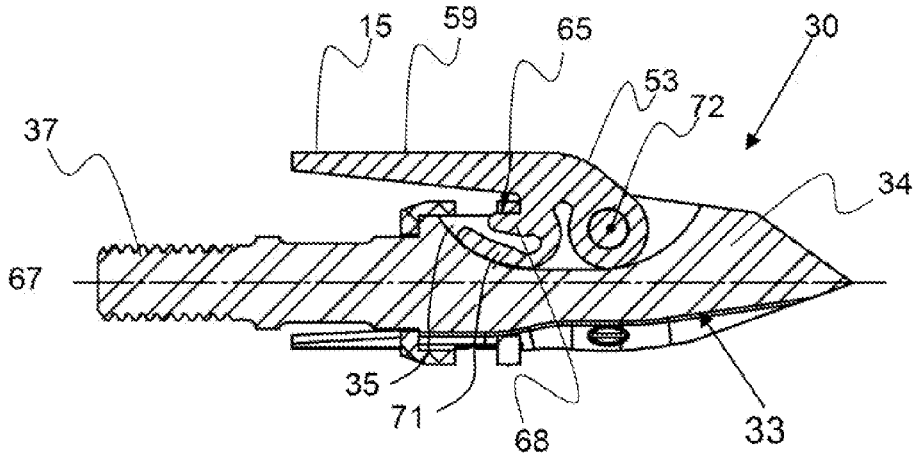

FIG. 25A shows a side cross-sectional view of the exemplary arrowhead shown in FIG. 22A along the arrowhead centerline.

Figure 25B:
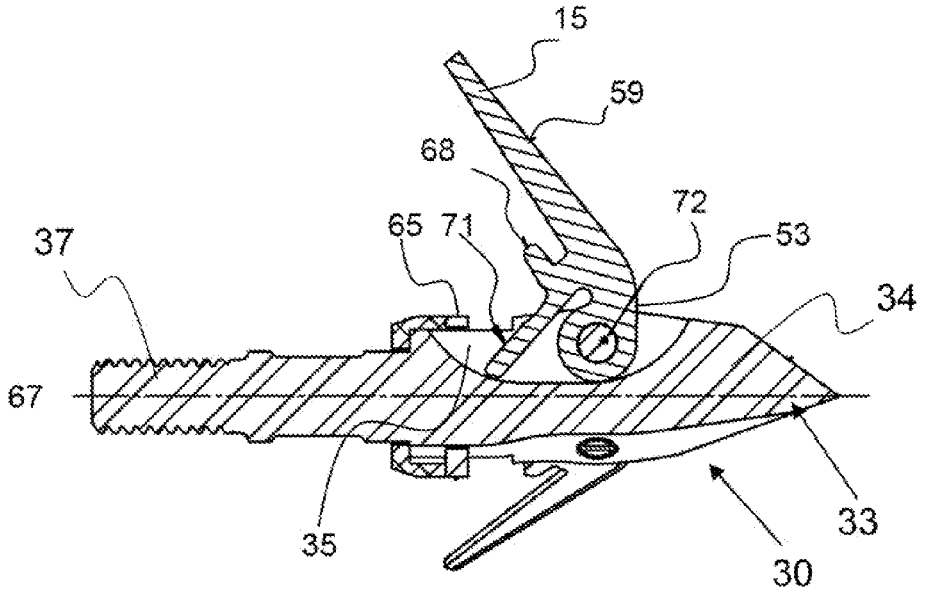

FIG. 25B shows a side cross-sectional view of the exemplary arrowhead shown in FIG. 22B along the arrowhead centerline.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

FIG. 1 shows a conventional fixed blade broadhead.

FIGS. 2A-2D show conventional mechanical blade inserts and how they open with a free end that is configured forward a fixed end.

As shown in FIG. 3, an arrow 12 is configured with two exemplary bird-wing broadhead blades 15, 15' in a back and retained orientation. The bird-wing broadhead blades have a cutting surface 54 that extends from a fixed end 78 to a free end 76. The bird-wing blades are made out of a shape memory material 50. The entry plane of the blades 60 is shown by the two vertical double-arrow lines. The blade cutting surface 54 has a portion that will be exposed to an object upon entry, or entry cutting surface 53. The portion of the cutting surface tucked back closer to the centerline CL of the arrow than the entry plane is a protected cutting surface 59, and will not be exposed to the outer surface of an object upon entry. The direction of flight of the arrow is shown by the large arrow above the arrow tip. The free ends of the bird-wing broadhead blades are downstream or back from the fixed end. The blades shown in FIG. 3 may be shape memory blades or any suitable type of blade that may be strained into the retained configuration as shown. The entry end 110 of the arrow and broadhead as well as the trailing end 112 of the broadhead are shown in FIG. 3.

As shown in FIG. 4, an exemplary arrow 12 has an arrow point 32, an arrow shaft 20 and an bird-wing insert 51 comprising exemplary shape memory bird-wing blades 15 retained by a retainer 65. The arrowhead 30 comprises the arrow point 32 and the birdwing insert 31. The arrow point 32 is configured to screw into a leading end of the bird-wing insert 31 and the arrow shaft 20 is configured to screw onto the trailing end of the bird-wing insert. Male threaded portions 37, 37' and female threaded portions or threaded apertures 38, 38' are configured for coupling the components of the arrow together as shown. The bird-wing broadhead blades 15 have a protrusion type retainer portion 55 that aids in retaining the retainer. It is to be noted that an insert may simply have an aperture for positioning between and arrow head and shaft or arrowhead body.

As shown in FIG. 5, an exemplary arrow 12 comprising two bird-wing broadhead blades 15, 15' is entering the hide 90 of a game animal 99. The head or point 32 of the arrowhead 30 has passed through the hide and is in the flesh 92 of the game animal. The two bird-wing broadhead blades will enter the game animal through the entry plane of the blades 60 as indicated by the double-arrows on the most extended portion of the retained blades.

As shown in FIG. 6, an exemplary arrow 12 comprises two bird-wing broadhead blades that have partially penetrated into the flesh 92 of a game animal 99. The retainer 65 will be forced off of the bird-wing broadhead blades as it passes into the hide 90. The two arrows pointing down and away from the retainer indicate the removal of the retainer upon entry into the game animal.

As shown in FIG. 7, an exemplary arrow 12 comprising two exemplary bird-wing broadhead blades is in a deployed orientation, with the free ends 76 extended out to a more forward position, as indicated by the two arrows. The entry cutting surface 53 may be dulled by entry into an object, such as the hide of an animal as indicated by the dashed line along the entry cutting surface. The protected cutting surface 59 however, is not exposed until the retainer is removed and the bird-wing broadhead blades extend out to an extended position. The protected cutting surface will be sharp and cut more effectively than a dulled surface.

As shown in FIG. 8, an exemplary arrow 12 has two exemplary bird-wing broadhead blades in an extended orientation within the flesh 92 of a game animal 99. The bird-wing broadhead blades have extended out only after entry into the object, or game animal in this example. The protected cutting surfaces may provide for better penetration and cutting within the object. The two exemplary bird-wing broadhead blades extend out far beyond the entry plane 60, 60' of the blades in a retained position.

The exemplary bird-wing broadhead blades shown in FIG. 5-8 may be coupled directly to an arrowhead or be part of a bird-wing insert, as shown in FIG. 4. In addition, the exemplary bird-wing broadhead blades shown in FIG. 5-8 may be made out of shape memory alloy blades or comprise any suitable material that may be strained down into a retained orientation.

As shown in FIG. 9A, an exemplary bird-wing blade insert 51 has a set shape. The insert has an aperture 77 for sliding the insert onto an arrowhead. As shown in FIG. 9B, the exemplary bird-wing blade insert 51 shown in FIG. 9A is held in a strained state or shape. The two arced arrows indicate bending of the bird-wing broadhead blades down into the strained shape. As shown in FIG. 9C, an exemplary bird-wing blade insert 51, with the bird-wing broadhead blades in a strained state, is retained on a broadhead arrow 12. A portion of the bird-wing broadhead blades 15, 15 is configured within a slot 35 or recess within the arrowhead body 34.

As shown in FIG. 9D, an exemplary bird-wing blade insert 51 has bird-wing broadhead blades 15 in a set shape, or extended out.

As shown in FIG. 9E, an exemplary bird-wing broadhead blade 15 has a cutting surface 54, a first planar surface 80, a second planar surface 82, and a thickness Tb therebetween. The blade may comprise or consist essentially of a shape memory material such as nitinol or other suitable material that may be strained down into a retained orientation or strained state.

As shown in FIG. 10, an exemplary bird-wing insert 51 comprise three bird-wing broadhead blades 15, 15' and 15" in a set shape and an insert body 61 having slots 35, 35' for positioning blades in a strained state. The insert also comprises a male threaded 37 stud on the back end and a threaded aperture 38 on a forward end. The bird-wing insert 51 has a length 39 as indicated by the double-arrowed line. The fixed ends 78 of the bird-wing broadhead blades are attached to the bird-wing insert 51. The bird-wing broadhead blade length 79 extends from the fixed 78 end to the free end 76.

As shown in FIG. 11, an exemplary bird-wing insert 51 has a spring 70 that is configured to actuate the bird-wing broadhead blades 15, 15'. The spring is compressed as the bird-wing broadhead blades are folded down toward the arrow shaft, as shown by the bird-wing broadhead blade 15'. The shape of the bird-wing broadhead blade about the fixed end or pivot 72 will determine how much compression of the spring will occur as the blade is folded down and retained. The bird-wing broadhead blades have a retainer recess 66 for retaining a band or loop type retainer, for example. A retainer recess may not be a cutting surface or a less sharp cutting surface than the rest of the cutting surface 54 of the bird-wing broadhead blade 15. As shown in FIG. 11, the bird-wing broadhead blade has an entry cutting surface 54 that extends out to the entry plane and a protected cutting surface 59 that is tucked back within the entry plane.

As shown in FIG. 12, the bird-wing insert 51 shown in FIG. 11 has both bird-wing broadhead blades 15, 15' tucked down into a retained position with a retainer 65 configured thereon. The entry offset distance 63, 63' is shown as the distance from the centerline 67 of the arrow to the entry plane of the blades in a retained orientation. The blades are under a force from the spring, and the spring will push down and deploy the blades when the retainer is removed, as indicated by the two large arrows.

As shown in FIG. 13, the bird-wing insert 51 shown in FIG. 12 has been deployed. The spring 70 has forced the two bird-wing broadhead blades 15, 15' out, whereby the free end extends to an extended offset distance 64, 64'. The extended offset distance is a distance from the centerline of the arrow to the extended free end of a bird-wing broadhead blade. The extended offset plane of the blades 62 is the circumferential plane around the broadhead at the free and extended ends 76 of the blades. The spring automatically actuated the blade to unfold when the retainer is released. As described herein, this will not occur until the retainer impacts an object upon entry, thereby protecting a portion of the cutting surface 54 of the bird-wing broadhead blades.

As shown in FIG. 14, the arrow and bird-wing insert shown in FIG. 13 are hitting an object 95, such as a bone within an animal. The bird-wing broadhead blade 15 is being compressed down as the blade passes by the object, thereby preventing velocity loss and preventing the blade from breaking. As shown in FIG. 2D, a conventional mechanical blade cannot give or deflect, as the blade 43' impacts an object 95, which will dramatically slow the arrow and/or break the blade. The deflected offset distance 74 is shown in FIG. 14. A fixed blade cannot deflect and therefore would not have a deflected offset distance.

As shown in FIG. 15, an exemplary bird-wing insert 51 is configured on an arrow 12. The bird-wing insert comprises a discrete spring 70, 70 for each bird-wing broadhead blade 15, 15' respectively. This configuration may more effectively allow each blade to give or deflect as required when impacting an object and may facilitate loading the blades in a retained orientation.

The spring(s) 70 in FIG. 11 through 15 are configured forward the bird-wing broadhead blades, or proximal to leading end or tip of the arrow, than the fixed end of the blades. It is to be understood that the bird-wing inserts 51 shown in FIG. 11 through 15 may be configured as part of the arrowhead itself.

As shown in FIG. 16, an exemplary bird-wing insert 51 has a spring 70 configured back, or downstream of, the fixed end 78 of the bird-wing broadhead blades 15, 15'. The spring is compressed as the bird-wing broadhead blades are folded down toward the arrowhead body.

As shown in FIG. 17, the bird-wing insert 51, as shown in FIG. 16 has both bird-wing broadhead blades 15, 15 extended out. The spring 70 is pushing up against the backside 69 of the bird-wing broadhead blades. The bird-wing broadhead blades may be configured to hit a stop or portion of the insert or arrowhead to prevent them from rotating beyond a certain point.

As shown in FIG. 18, an exemplary bird-wing insert 51 has two springs 70, 70' configured back, or downstream, of the fixed end 78 of the bird-wing broadhead blades 15, 15'. The spring 70' is compressed as the bird-wing broadhead blade 15' is folded down toward the arrowhead body.

As shown in FIG. 19A, an exemplary arrow 12 has six birding broadhead blades 15 in a retained and strained configuration. The entry cutting surface 53 is exposed in a front end view, as shown in FIG. 19A.

As shown in FIG. 19B, an exemplary arrow 12 has six birding broadhead blades 15 in an extended configuration. Both the entry cutting surface 53 and protected cutting surfaces 59 are exposed in this view. The use of a harder metal, such as nitinol may allow for more blades to be configured on an arrowhead. More blades may result in more cutting and better hunting results.

As shown in FIG. 20, an exemplary arrow 12 has an arrow point 32, shaft 20, blades 15, fletches 24 and an arrow end 29. The leading end of the arrow is the arrow point 32 and the trailing end of the arrow is the arrow end 29.

As shown in FIG. 21A, an exemplary arrowhead 30 has exemplary bird-wing blades 15A and 15B in a retained configuration. A third bird-wing blade is configured in a location that is not visible from this view. The blade cutting surface 54 is uninterrupted with a retainer recess in this embodiment. The blades are retained by a collar or ring shaped retainer 65 that extends over a retainer extension 68A and 68B shown in FIG. 21B. The retainer extensions 68A and 68B are configured inside of the cutting surfaces 54 of the blades, or between the cutting surfaces and the arrowhead body 34. The blades 15A, 15B are configured partially within a slot 35 in the arrowhead body 34. The entry cutting surface 53A, 53B of the blades 15 will be exposed to an object upon entry and the protected cutting surfaces 59 will be extended out when the retainer 65 is pushed back by entry of the arrowhead into an object. The entry cutting surface is the portion of the cutting surface that is visible from a front end view of the arrow or arrowhead, as generally shown in FIG. 19. The extended blades provide for a much larger cutting diameter. The retainer 65 is pushed back in FIG. 21B as indicated by the large arrow. The retainer extensions 68 extend from an inside surface of the blades 15 as shown in FIG. 21B.

As shown in FIG. 22A, an exemplary arrowhead 30 has exemplary bird-wing blades 15A, 15B in a retained configuration. Again a third bird-wing blade is not visible in this view.

As shown in FIG. 22B, the exemplary arrowhead 30 shown in FIG. 22A has the retainer 65 pushed back and the exemplary bird-wing blades 15A, 15B in an extended configuration. The spring blade portion 71 of the blade 15A is configured to push the blade out, or extend the blade, when the retainer is pushed back. The spring blade portions 71 are configured inside of the cutting surfaces 54 of the blades, or between the cutting surfaces and the arrowhead body 34. The spring blade portion may be configured to fold or bend to provide an effective spring force to return the blades to an extended configuration, or to move the free end of the blades in a forward direction. The blade in this configuration may be made out of spring steel, nitinol, or any other suitable metal that can be deformed to create a spring blade portion. Male threads 37 are configured on the trailing end of the arrowhead 30 for attachment to an arrow shaft.

As shown in FIG. 23A, an exemplary arrowhead 30 has exemplary bird-wing blades 15A-15C, in a retained configuration. The entry diameter 102 of the arrowhead is shown in a dashed line around the arrowhead. The entry diameter is the largest diameter created by the entry cutting surface portion of the bird-wing blades. The entry diameter defines an entry plane 60 of the blades As shown in FIG. 23B, the exemplary arrowhead shown in FIG. 23A has the exemplary bird-wing blades 15A-15C in an extended configuration. The extended diameter 104 of the arrowhead is shown in a dashed line around the arrowhead. The extended diameter is the largest diameter created by the extended bird-wing blades. The extended diameter defines an extended plane 62 of the blades. As shown, the extended diameter is more than double the entry diameter shown in FIG. 23A. The ratio of extended diameter to entry diameter may be any suitable value including, but not limited to, greater than about 1.25, greater than about 1.5, greater than about 2.0, greater than about 2.5, greater than about 3.0 and any range between and including the ratios provided.

As shown in FIG. 24, an exemplary bird-wing arrowhead 30 comprises an arrowhead body 34 and a plurality of blades 15A-15C. The bird-wing blades comprise a blade aperture 73 that is configured as a pivot 72 for the blade. The blades have a fixed end 78, retained by the post 108, and a free end 76. The blades 15A-15C are each a one-piece unit and also comprise a retainer extension 68 and a spring blade portion 71. The blades are configured to be inserted into the slot 35 and retained by the post 108, as indicated by the dashed lines extending from blade 15B and post 108. The retainer 65 and retainer collar 106 are configured with apertures for placement over the trailing end of the arrowhead body 34.

As shown in FIG. 25A, the exemplary arrowhead shown in FIG. 22A along the arrowhead centerline comprises a slot 35 for retaining the blade 15. The retainer extension 68 is retained by the retainer 65 and the spring blade portion is deflected or deformed to provide a spring force for the bird-wing blade. The spring blade portion is bent and retained in the slot 35 in a stored energy configuration. As soon as the retainer 65 is pushed back upon entry into an object, the spring blade portions of the blade extend to a previous state, or shape memory configuration, and thereby extend the bird-wing blades out, or in forward direction, as shown in FIG. 25B. The birdwing blade rotates out to an extended configuration about the pivot 72. In an exemplary embodiment, the bird-wing blades as shown in FIGS. 25A and 25B are a one-piece unit and are made out of nitinol or spring steel, for example. In another embodiment, only a portion of the blade is configured out of a shape memory or spring steel type of material, such as the spring blade portion. For example, the cutting surfaces of the blade, or blade extensions may be made out of a first material, such as steel, and other portions of the blade, such as a retainer extension and/or a spring blade portion may be made out of a second material, such as nitinol.

The term, forward, as used herein, refers to the leading or entry end of an arrow or broadhead, such as the arrow point or tip being the most "forward" part of the arrow. The term back is used to designate the trailing end or a more back position along an arrow or broadhead.

The term upstream, as used herein, refers to a position more proximal to the leading or entry end of the arrow or broadhead. The term downstream, as used herein, refers to a position more proximal to the trailing end of an arrow or broadhead.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A broadhead comprising:

a. at least one bird-wing blade having a set shape; and b. a retainer configured to retain the at least one bird-wing blade in a strained state;

wherein said retainer is configured to release said at least one bird-wing blade from the strained state upon entry into an object and whereby upon release of the retainer, said at least one bird-wing blade is configured to automatically return substantially to the set shape.

2. The broadhead of claim 1, wherein the at least one bird-wing blade comprises a shape memory material.

3. The broadhead of claim 1, wherein the at least one bird-wing blade comprises nitinol.

4. The broadhead of claim 1, wherein the at least one bird-wing blade is configured as an insert and is detachably attachable to the broadhead.

5. The broadhead of claim 1, comprising two or more bird-wing blades configured as an insert that is detachably attachable to the broadhead.

6. The broadhead of claim 1, comprising:

a. an arrowhead body having an entry end and a trailing end;

wherein the at least one bird-wing blade has a fixed end and a free end;

wherein the retainer is configured to retain the at least one bird-wing blade in a strained state with the free end configured more proximal to the arrowhead body than when the retainer is released and the at least one bird-wing blade returns substantially to the set shape;

wherein the fixed end is configured more proximal to said entry end than said fixed end when the at least one bird-wing blade is retained by the retainer.

7. The broadhead of claim 6, wherein the at least one bird-wing blade comprises a cutting surface and said cutting surface comprises an entry cutting surface and a protected cutting surface;

wherein said protected cutting surface is configured more proximal to a free end of the at least one bird-wing blade than the entry cutting surface.

8. The broadhead of claim 7, wherein the at least one bird-wing blade has a length and wherein the protected cutting surface is configured along at least 25% of said length.

9. The broadhead of claim 6, wherein the arrowhead body comprises a slot configured to receive at least a portion of the at least one bird-wing blade.

10. The broadhead of claim 9, wherein the free end is configured to be retained in the slot.

11. The broadhead of claim 1, wherein the at least one bird-wing blade comprises a retainer portion configured to couple with the retainer to retain the at least one bird-wing blade in a strained state.

12. The broadhead of claim 11, wherein the retainer portion is a retainer extension.

13. The broadhead of claim 12, wherein the retainer extension extends inward from the at least one bird-wing blade.

14. The broadhead of claim 1, further comprising a spring configured to actuate the at least one bird-wing blade into an extended configuration when the retainer releases the at least one bird-wing blade from a strained state.

15. The broadhead of claim 14, wherein the spring is configured more proximal to an entry end of the broadhead than a pivot point of the at least one bird-wing blade.

16. The broadhead of claim 14, wherein the spring is configured more proximal to a trailing end of the broadhead than a pivot point of the at least one bird-wing blade.

17. The broadhead of claim 1, wherein the at least one bird-wing blade comprises a spring blade portion;

wherein said spring blade portion is configured to be held in a strained state when the at last one bird-wing blade is retained by the retainer; and wherein said spring blade portion is configured to return to an extended shape when the retainer is released.

18. The broadhead of claim 17, wherein the at least one bird-wing blade and the spring blade portion are a one-piece unit and are constructed from a single material.

19. The broadhead of claim 18, wherein the at least one bird-wing blade and the spring blade portion are a shape memory material.

20. A broadhead comprising:

a. an arrowhead body having an entry end and a trailing end;

b. at least one bird-wing blade having a fixed end and a free end;

c. a retainer configured to hold the at least one bird-wing blade in a retained state with the free end configured more proximal to the arrowhead body than when the retainer is released;

wherein the fixed end is configured more proximal to said entry end than said fixed end when said at least one bird-wing blade is retained by said retainer;

wherein said retainer is configured to release said at least one bird-wing blade from said retained state upon entry into an object, whereby said at least one bird-wing blade automatically moves into an extended state upon release of the retainer;

wherein the at least one bird-wing blade comprises a shape memory material.

21. A broadhead comprising:

a. an arrowhead body having an entry end and a trailing end;

b. at least one bird-wing blade having a fixed end and a free end;

c. a retainer configured to hold the at least one bird-wing blade in a retained state with the free end configured more proximal to the arrowhead body than when the retainer is released;

wherein the fixed end is configured more proximal to said entry end than said fixed end when said at least one bird-wing blade is retained by said retainer;

wherein said retainer is configured to release said at least one bird-wing blade from said retained state upon entry into an object, whereby said at least one bird-wing blade automatically moves into an extended state upon release of the retainer;

wherein the at least one bird-wing blade consists essentially of a shape memory material and the extended state is a set shape of the shape memory material.

* * * * *